US010050419B2

(12) United States Patent
Wang et al.

(10) Patent No.: US 10,050,419 B2
(45) Date of Patent: Aug. 14, 2018

(54) CONTROLLED THIN-FILM FERROELECTRIC POLYMER CORONA POLARIZING SYSTEM AND PROCESS

(71) Applicant: Areesys Technologies, Inc., Fremont, CA (US)

(72) Inventors: Kai-An Wang, Cupertino, CA (US); Efrain A. Velazquez, San Jose, CA (US); Craig W. Marion, Livermore, CA (US); Michael Z. Wong, Castro Valley, CA (US); Albert Ting, San Jose, CA (US); Wen-Chieh Geoffrey Lee, Taipei (TW)

(73) Assignee: Areesys Technologies, Inc., Fremont, CA (US)

( * ) Notice: Subject to any disclaimer, the term of this patent is extended or adjusted under 35 U.S.C. 154(b) by 0 days.

(21) Appl. No.: 15/333,218

(22) Filed: Oct. 25, 2016

(65) Prior Publication Data

US 2017/0310087 A1 Oct. 26, 2017

Related U.S. Application Data

(60) Provisional application No. 62/324,935, filed on Apr. 20, 2016.

(51) Int. Cl.
*H01T 19/04* (2006.01)

(52) U.S. Cl.
CPC ..... *H01T 19/04* (2013.01)

(58) Field of Classification Search
CPC ..... H01T 19/04
(Continued)

(56) References Cited

U.S. PATENT DOCUMENTS

2003/0096065 A1* 5/2003 Berneth ..... C08F 246/00 428/1.1
2016/0076798 A1* 3/2016 Zhang ..... F25B 21/00 62/3.1

OTHER PUBLICATIONS

The Science of Hysteresis, vol. 3; I. Mayergoyz and G. Bertotti (Eds.), Elsevier (2005), Chapter 4, 5 pgs, Copyright 2006, Elsevier Inc.

(Continued)

*Primary Examiner* — Nicole Ippolito
(74) *Attorney, Agent, or Firm* — Saile Ackerman LLC; Stephen B. Ackerman

(57) ABSTRACT

A corona polarization (also denoted "poling") process and associated apparatus polarizes a ferroelectric polymer thin film while monitoring and evaluating a substrate current whose magnitude, slope and noise profile (Barkhausen noise) varies in accordance with phase transformation processes of crystallites within the film and, thereby, provides an indication of the polarization status. The electric current flowing through the microstructures of the thin film can be modeled by an equivalent circuit, within which electrical charges stored in the respective microstructures are denoted by a plurality of discrete components (e.g., capacitors). Alternatively, the process can be modeled in terms of a hysteresis loop of polarization vs. electric field, corresponding to the availability of recombination sites on the thin-film surface. By comparing the measured substrate current to the result derived from the equivalent circuit, the major processing parameters such as poling current and voltage can be adjusted via an in-situ manner throughout the corona poling process and an accurate process endpoint can be established. As a consequence, a ferroelectric thin film is fabricated that has an enhanced piezoelectric effect yet minimized aging problems.

27 Claims, 10 Drawing Sheets

(58) Field of Classification Search
USPC ..... 250/324, 423 R, 492.3
See application file for complete search history.

(56) References Cited

OTHER PUBLICATIONS

Sandia Report, "Characterization, Performance and Optimization of PVDF as a Piezoelectric Film for Advanced Space Mirror Concepts," by Tim R. Dargaville, et al., SAND2005-6846, Nov. 2005, Sandia National Laboratories, pp. 1-49.
"Dynamics of a ferromagnetic domain wall: Avalanches, depinning transition, and the Barkhausen effect," by Stefano Zapperi et al., Physical Review B, vol. 58, No. 10, Sep. 1, 1998-II, pp. 6353-6366.
"Ferroelectric Polymer Thin Films for Organic Electronics," by Manfang Mai et al., Hindawi Publishing Corporation, Journal of Nanomaterials, vol. 2015, Article ID 812538, 14 pgs, Jan. 2, 2015.
"On the Role of Charge Injection and Trapping in Stability of Polarization in Ferroelectric Polymers," by Sergei Fedosov et al., (ISE 8), 8th International Symposium on Electretes, Jan. 1, 1994, pp. 600-605.
"Some Features of the Electric Relaxation in PVDF and PVDF-PZT Composites," by A. E. Sergeeva et al., (ISE 8), 8th International Symposium on Electrets, Jan. 1, 1994, pp. 748-753.
"Conductive Domain Walls in Ferroelectric Bulk Single Crystals," Dissertation of Mathias Schroder, Technische Universitat Dredson, Dec. 19, 2013, 1 pg.

* cited by examiner

CONTROLLED THIN-FILM FERROELECTRIC POLYMER CORONA POLARIZING SYSTEM AND PROCESS

This application claims benefit of U.S. Provisional Patent Application No. 62/324,935, filed on Apr. 20, 2016, which is herein incorporated by reference in its entirety.

TECHNICAL FIELD

The present disclosure relates to a controlled corona polarizing (i.e. "poling") process and system for ferroelectric polymer thin films, and in particular to a poling process technology that controls and optimizes the polarization of a pressure sensing thin film by monitoring the substrate current using Barkhausen noise as an index of crystallization of the thin film.

BACKGROUND

The corona poling (also, "polarization") process has been widely used in industry as a means of polarizing ferroelectric polymer thin-film materials (e.g., poly-vinylidene difluoride, PVDF; PVDF-TrFE, PMMA, TEFLON, etc.). Compared to other processing methods (e.g., contact electrode poling), corona poling is considered superior in that it does not require deposition of an additional contact poling electrode layer on the ferroelectric polymer material. When a ferroelectric polymer film does not require a contact poling electrode layer, it will have a clean surface throughout the entire corona poling process, thus leading to a finished product free from any unwanted interfacial problems, such as charge recombination sites. A polarized PVDF film without a contact poling electrode layer on a top surface can be directly used on a flat panel display. This ease-of-use could initiate a new wave of market demand for the touch-force-sensing feature on flat panel display devices in the future.

FIG. 1 shows a present state of art corona poling process chamber (100). A high voltage (e.g., from 10 kV to 50 kV) needle (101) is placed in the upper portion of the poling process chamber (100); during the corona poling process, this needle (101) serves as the electrode to excite the corona. In a typical corona poling process, atmosphere may be used as the processing ambient. Occasionally the processing ambient may be blended with certain amounts of purified $N_2$, humidity, etc., for different processing purposes. As FIG. 1 also shows, a conductor grid (102) is placed between the high voltage needle (101) and the substrate (103). During the corona poling process, the conductor grid (102) is charged to a high voltage, whose value is higher than that of the substrate (103) but lower than that of the high voltage needle (i.e. Voltage 1 in FIG. 1). The voltage of the conductor grid (i.e. Voltage 2) is set in this manner mainly for three purposes. First, together with the high voltage needle, they establish an electric field (i.e. $E_{drift\ field\ in\ corona}$) in the distance between them (i.e., $D_{needle\ to\ grid}$). Eq. (1) gives the value of such an electric field.

$$E_{drift\ field\ in\ corona} = \frac{\text{Voltage}_1 - \text{Voltage}_2}{D_{needle\ to\ grid}} \tag{1}$$

In a corona generated by the environment depicted in FIG. 1, it is this corona drift electric field $E_{drift\ field\ in\ corona}$ that drives the needle-generated ions (e.g., 105) toward the conductor grid (102). Second, together with the grounded polymer substrate (103), the conductor grid (102) establishes another electric field (i.e. $E_{poling}$) in the distance (i.e. $D_{grid\ to\ polymer}$) between the conductor grid (102) and polymer substrate (103), i.e.

$$E_{poling} = \frac{\text{Voltage}_2}{D_{grid\ to\ polymer}} \tag{2}$$

The poling electric field $E_{poling}$ drives the ions (e.g., 104) through the holes in the conductor grid (e.g., 106) toward the polymer substrate (103). The voltage of the conductor grid (102) also has a third effect. That is, when the ionic species (104) reach the polymer layer (103), they will charge the top surface of the polymer layer to a voltage level that is largely comparable to the conductor grid voltage. In solid state physics, this is tantamount to changing the work function of the top surface of the polymer; the bottom surface is unchanged given that the polymer is a good insulator. The deposited electrical charges (depending on the processing ambient used, they can be either positive or negative) will then be dissipated over the top surface of the polymer layer (103). When the charges reach the edges of the polymer, they will encounter processing elements (e.g., a substrate holder, or a switch specially designed to collect such charges, or the like), through which the charges will be transferred to the ground. As a result, during the presently disclosed corona poling process, the electrical charge provided by the poling current (107) and the charge lost to the ground will reach a steady state, at which time the entire top surface of the ferroelectric polymer layer will be sustained at a specific voltage value. As can be imagined, such a steady state voltage value is strongly influenced by the voltage of the conductor grid (i.e. Voltage 2); note that the distance between the conductor grid and the polymer substrate $D_{grid_to\ polymer}$ is so short (i.e. in the range of mm) that it can be considered as an electrical short circuit path between the two media. When the above described steady-state condition is reached, the final voltage of the top surface of the polymer layer (103) can reasonably be assumed to be that of the conductor grid (i.e. Voltage 2). As to the bottom surface of said polymer layer, since it is electrically isolated from the top surface by the thickness of the polymer layer $t_{polymer}$, the voltage value thereon will not be affected by the conductor grid voltage, i.e. it will be zero volts.

Determining the Magnitude of in-Film Electric Field in a Ferroelectric Polymer

Assuming the dielectric constant of the polymer layer (103) is close to 1, the above stated poling current (107) will establish an in-film electric field $E_{in\text{-}film}$ across the top and bottom surfaces of said polymer substrate, whose value is denoted by $$E_{in\text{-}film} = \frac{V_{top_surface_polymer} - V_{bottom_surface_polymer}}{t_{polymer}} = \frac{V_{metal_grid} - 0}{t_{polymer}} \tag{3}$$

where $V_{top_polymer_surface}$ is the voltage of the top surface of the ferroelectric polymer material, $t_{polymer}$ is the thickness of the polymer, and $E_{in\text{-}film}$ is the in-film electric field across the thickness of the polymer material.

As an example, in a typical process conducted by the present system, the voltage of the conductor grid is set around 5 kV, and the thickness of the ferroelectric polymer material is in the regime of μm. For such a thin film, it will establish an in-film electric field as high as $10^9$ volts/meter.

We now refer to schematic FIGS. 2 and 9, in which the features that can affect a corona poling process are provided. To repeat, the present system uses an in-film electric field $E_{in\text{-}film}$ to pole (i.e. modify polarity by electric field) a ferroelectric polymer film. Before entering a detailed discussion, we have to identify the direction of the in-film electric field. The method of designating such a direction will be used throughout the present disclosure. As FIG. 9 shows, the in-film electric field $E_{in\text{-}film}$ has a predominant directionality along the Z axis. That is, in the polymer film being poled, there is a substantially large electric field in the Z axis, but there is very little or no electric field in the X or Y-axis of the coordinate system of FIG. 9. When the thickness parameter $t_{polymer}$ is in the range of μm, even a voltage of several volts suffices to establish an in-film electric field of several million volts/meter between the top and bottom surfaces of the ferroelectric polymer. Such an in-film electric field is so high that it can easily realign the dipoles (e.g., changing their directions, etc.) of a dielectric material. It is this unique ability to create dipole realignment by means of a strong in-film electric field in a single direction that polarizes, or poles, a ferroelectric polymer film. However, to make a corona poling system workable in a mass-production environment that includes delicate microelectronic devices, (such as a touch sensing feature on a flat panel display), there are several outstanding challenges, including maintaining productivity, dealing with the piezoelectric effect, product uniformity, product longevity and the like, lying before us. We will briefly discuss some of the physical/material issues that need to be dealt with.

Phase Transformations in a Ferroelectric Polymer Thin Film as a Consequence of an Extraordinarily Large in-Film Electric Field In its bulk form, a commodity type PVDF thin film material is un-polarized in that the PVDF material is made directly out of melt. In such an un-polarized PVDF material, it is the α phase crystallite that dominates the crystalline structure of the matrix. However, to achieve the piezoelectric effect as required by a touch sensitive flat panel display, it is primarily the β phase that is useful. Thus, upon receiving a PVDF thin film that has been spray coated on a glass sheet, a method is required to transform the PVDF film from the α phase dominated matrix to one that is rich in β phase. To achieve this goal, conventional art has developed many ways to apply a substantially large electric field on the ferroelectric polymer. However, conventional art has not developed a process with which to control the α to β phase transformation. More specifically, today all that a process engineer knows is there is an abrupt increase of the population of β phase crystallites when a poling process reaches some critical condition. Indeed, since such an effect is mostly prominent in the Z axis, as has been explained earlier; so when or how this event happens is not clear to prior art, and the final value of β phase concentration will reach a plateau at an arbitrary value after the specimen has been poled by a specific electric field at a pre-defined temperature (e.g., 70-87° C. for PVDF) for a period of time (e.g., 30 min). It is still not clearly known to the industry as to how the above stated processing parameters influence one another.

Importance of Barkhausen Noise

Previous reports have disclosed that when a β phase transformation occurs, a great deal of electrical noise emanates from a ferroelectric material. This is the so-called Barkhausen noise. Most studies of Barkhausen noise has centered on metallic materials; but the study of Barkhausen noise in polymer materials has been relatively neglected and only primitive studies have been done. In fact, the relationship between Barkhausen noise and the status of phase transformation of a ferroelectric polymer thin film is very strong, and this fact is largely attributed to the extraordinarily large in-film electric field applied across a dielectric material of only a few μm in thickness. This relationship is the fundamental reason why the presently disclosed method can determine a process ending time, final polarity of a ferroelectric polymer thin film in a robust manner.

It is to be noted that what a process engineer normally investigates to determine the status of a corona poling process is the substrate current. To do a Barkhausen noise test on a ferroelectric polymer thin film, the process engineer connects a grounding wire to the ferroelectric polymer and thereafter the Barkhausen noise can be detected by an electrometer that links to the grounding wire. Meanwhile, despite the fact that studies have revealed that Barkhausen noise has many things to do with the poling process of a ferroelectric polymer thin film, the industry has not developed any effective means to take the advantage of Barkhausen noise, especially with a view towards controlling or improving the fundamental property of a ferroelectric polymer thin film. In the section of embodiments, the presently disclosed process will be associated with three examples, embodiments one, two, and three, to establish the fact that the crystalline structure of a ferroelectric polymer thin film can be manipulated by various corona poling process systems/means. For example, the performance of a PVDF film poled by a continuous type in-line corona poling system will be vastly different than that of the static, single chamber one of FIG. 3. The Barkhausen noise generated by the two types of in-line systems are also vastly different. In the past, the root causes of these variations were unclear to the process engineer. In fact, the complicated relationships between Barkhausen noise and the final characteristics of the ferroelectric polymer thin film has confused many process engineers. In the following paragraphs, the presently disclosed process will be used to elaborate their root causes, i.e. the fundamental reasons for causing said Barkhausen noise to occur/vary in different situations.

To assess the merits of a corona poling process by using Barkhausen noise to predict the ending point of said process, the directionality of the in-film electric field must be specified first, and the device used to measure said Barkhausen noise (e.g., a volt meter or current meter at a precision level of μV or nano-Amp) must be identified, so that the spikes of the Barkhausen noise can provide information meaningful for a process engineer to use. In the past, no prior art has achieved this capability. The end point of the conventional corona poling process for ferroelectric material was arbitrarily chosen (e.g., using a timer, etc.). The presently disclosed method is unique in the addition of an end point detecting feature to a corona poling process that is based on measureable, physical quantities.

FIG. 2 shows the relationship between the voltage of the conductor grid (102) and the electrical current produced by charges deposited on a ferroelectric polymer substrate (i.e. the poling current (107)) under three different voltage values of the high voltage needle, denoted in descending values as Voltage 1A, 1B, and 1C. As FIG. 2 shows, the magnitude of the poling current (107) may increase with the voltage of the conductor grid either linearly (e.g., curve 202) or non-linearly (e.g., curve 201); the shape of the curves largely depending on the voltage applied to the key components of the system (e.g., conductor grid voltage, Voltage 2 (102), and the voltage of the high voltage needle, Voltage 1 (101)). In further detail, as FIG. 2 shows, when the voltage, Voltage 1, of the high voltage needle (now denoted Voltage 1A) is much larger than that of nominal poling process condition (e.g., Voltage 1A>>Voltage 1B; a typical value of Voltage 1A can be as high as 50 kVolts), a non-linear behavior will result (denoted by curve 201). However, if the voltage of the high voltage needle is within nominal range (e.g., at Voltage 1B), the shape of the poling current curve can become a linear one (denoted by Curve 202). In a production environment, the process engineer would desire the profile of a poling current to be linear (i.e. 202). To avoid non-linear behavior, the voltage of the high voltage needle may have to be reduced to a lower value (i.e. Voltage 1C) substantially lower than that of a nominal poling condition (i.e. Voltage 1B) to prevent the poling process from "running away" (or any other uncontrollable behavior that is a result of non-linearity). This tactic pays a price—when the voltage of the high voltage needle (Voltage 1) is set too low, as curve (203) shows, the magnitude of said poling current (107) is decreased proportionally; this inevitably forces a corona poling process to require an extended processing time in order to polarize a ferroelectric polymer material completely. Whenever this happens (i.e. poling current too low), the productivity of the corona poling system is decreased. Faced with the above dilemma, non-linearity vs. extended processing time, the industry has been keenly looking for a new corona poling process, one that can add a high poling current to a ferroelectric polymer and monitor its status in an in-situ manner.

Microstructure of a PVDF Thin Film

FIG. 4 shows an experimental result, i.e., a poling current (400) characterizing a PVDF copolymer film being polarized by the presently disclosed corona poling process system. Here, the needle voltage is set at 20 kV and the conductor grid voltage is set at 7 kV, respectively. It is to be noted that, in accord with the fundamental property of ferroelectric material, there is a critical electric field for a PVDF polymer to transform α phase crystallites to β phase crystallites (e.g., 1.2 MV/cm when the temperature of the PVDF film is approximately 65° C.). When such a critical electric field condition is met, the above phase transformation process, from α to β crystallites, will take place, which results in re-aligning the polarity of the molecules embedded in the film. Note still further, the above stated polarity realigning process inevitably produces the movement of electrical charges (dipole distributions) within the bulk material. Thus, during the poling process of a ferroelectric polymer thin film, intermittent electrical current may flow through the bulk film, much like AC noise superimposed on a DC current. When the ferroelectric polymer thin film is connected to a grounding path, the substrate current (i.e. $I_{substrate}$ (3012) of FIG. 3) as measured by the current sensor (3011) is, therefore, a composite current that comprises the charge injected by the poling current ((107) of FIG. 1), trapped charges, mobile ions in the body of said polymer, and other species that may cause recombination with the poling charges. Hence, it is virtually an impossible challenge to understand the status of a corona poling process by diagnosing the form of the substrate current, let along using the result so derived to control said poling process in-situ.

Referring again to FIG. 4. As the spike (402) denotes, at the process elapse time of about 30 seconds (measured from the beginning of the poling process), the substrate current (400) surges to a magnitude that is 50% higher than that of the neighboring points (e.g., point 403). This spike (402) denotes some extraordinary event in the α to β phase transformation process within the PVDF copolymer film. If one observes the poling current (400), it can be seen that after passing the spike (402), the profile of the poling current (400) is no longer smooth, i.e., there are now numerous minor peaks in the poling current (400). Still further, once the spike (402) has occurred, the additional surges (e.g., point 404, 405, etc.) may take place throughout the rest of the poling process (i.e. denoted by segment 406), in a sporadic manner. This is because the magnitude of the in-film electric field has exceeded the above stated critical electric field and every so often an additional extraordinary event of the α to β phase transformation process may take place in said PVDF film. As the poling process proceeds, the amount of α phase crystallite available for phase transformation is gradually reduced; this is made evident by the gradually decreasing height of the corresponding spikes (e.g., 404 and 405, etc.). The slope of the poling current (400) also indicates the poling condition. At the beginning of the poling process, the slope of the substrate current (401) is quite steep; this actually indicates that the transportation process of the charges in the bulk film is dominated by the trapped charges, mobile ions, etc., rather than by the α to β phase transformation process. As the poling process proceeds, the magnitude of the electrical current contributed by the α to β phase transformation process becomes larger and more important. At point (402), the roles of the two mechanisms are balancing one another; that is, the magnitude of the substrate current contributed by the trapped charge transportation process is about the same as that generated by the α to β phase transformation process. In a corona poling process, once that point (402) is passed (the region denoted by 406), as the zig-zag profile of the substrate current (400) beyond point (402) indicates, an intense phase transformation process occurs in the PVD copolymer film. At the same time, as a result of the above described charge balancing effect, the slope of the segment (406) gradually becomes flat. Thus, point (402) literally denotes a coercivity of a ferroelectric polymer film. In FIGS. 7(A), (B), and (C), we use the parameter Ec of the corresponding hysteresis loop to characterize the above phenomenon (the sign of the current in FIGS. 4 and 7 is reversed, which does not affect the result). In FIG. 8, the steps (805), (806), and (807) of process flow (800) use the above stated characteristics to predict the ending point of a presently occurring corona poling process. As a result, a ferroelectric polymer film can be fabricated in a robust manner, making that ferroelectric property a final product of a quality unprecedented in the prior art.

FIG. 5 schematically depicts the substrate current (506) as well as its equivalent circuit loop (503) generated by a ferroelectric polymer thin film poled by the presently disclosed corona poling process system ((300) in FIG. 3). As has been explained in the previous paragraphs, there are now only two predominant sub-structures (i.e. β phase and amorphous PVDF) in a poled ferroelectric polymer material such as a PVDF thin film. As FIG. 5 shows, these two substructures can be characterized by two groups of charges, and correspondingly two variable capacitors (i.e. $C_{DW}$ and $C_{CHARGE\ DIFFUSION}$) that are connecting to one another in parallel. Thus, the magnitude of the substrate current (5010, which corresponds to $I_{substrate}$ in FIG. 3) as measured by the current meter (507, which corresponds to 3011 in FIG. 3) is actually subjected to the variation of said two capacitance values (i.e. $C_{DW}$ and $C_{CHARGE\ DIFFUSION}$). In practice, these two groups of charges (i.e. $C_{DW}$ and $C_{CHARGE\ DIFFUSION}$) may play different roles. For example, when these two sub-structures coexist in a touch-sensitive film, it is the crystalline structure, i.e. the β phase of PVDF (i.e. the charges represented by $C_{DW}$) that provides the piezoelectric effect desired by the user (e.g., in industry, most application engineers use a parameter $d_{3j}$ to designate the piezoelectric constant of a material in a direction denoted by 3). As to the amorphous sub-structure (i.e. whose trapped charges are represented by $C_{CHARGE\ DIFFUSION}$), it is unwanted in that the amorphous structure does not produce any piezoelectric effect. Meanwhile, when the two sub-structures (e.g., PVDF with a copolymer ingredient) are deposited on a conventional touch sensing pad (e.g., a capacitance-sensing feature, etc.), the charges in the amorphous substructure can provide the area touched by finger with an alternative grounding path, which initiates the changes of the capacitance value. In this regard, the amorphous structure is necessary. In most of the situations, an optimal ferroelectric polymer film would be characterized by a specific concentration of both sub-structures. Conventional corona poling processes cannot tell the difference between the two sub-structures (i.e. β crystallites and amorphous structure) in that their individual roles and contributions to a substrate current have not been clearly understood. The microstructure of a ferroelectric polymer generated by the conventional corona poling process often turns out to be one that varies in accord with the practitioner's process history, so that different phase concentrations of α, β, γ and δ phases, may exist in a PVDF film made using different processing tools. When a ferroelectric thin film is used on a delicate microelectronic device (e.g., a touch force sensing pad), a prior art corona poling process faces an unprecedented challenge, in that the performance of the ferroelectric polymer thin film, the productivity of the corona poling system, and the capabilities of the process engineers who implement the process, all need to be simultaneously considered within a single intelligent corona poling system. This is the gap that the present disclosure is intended to close.

SUMMARY

It is the first object of the present disclosure to polarize a ferroelectric polymer thin film by adding a substantially large in-film electric field using a robust corona poling process system.

It is the second object of the present disclosure to optimally polarize a ferroelectric polymer thin film while controlling other side effects, such as aging, within a manageable range.

It is the third object of the present disclosure to determine the condition of a ferroelectric thin film under a corona poling process based on a substrate current generated from said ferroelectric thin film.

It is the forth objective of the present disclosure to derive a process ending time for a ferroelectric polymer thin film under a corona poling process by measuring a substrate current displaying Barkhausen noise.

It is the fifth objective of the present disclosure to determine the condition of a corona poling process by detecting the slope of a substrate current that flows from the surface of a polymer thin film receiving a poling current to the ground, with no perturbations by intermediate parasitic components.

It is the sixth objective of the present disclosure to determine the state of a corona poling process by detecting the slope of a substrate current that flows to ground from the surface of a polymer thin film that has stopped receiving the poling current but still maintains a residual amount of charges thereon, with no perturbation of intermediate parasitic components lying in between.

It is the seventh object of the present disclosure to characterize a ferroelectric thin film undergoing a poling process by an equivalent circuit, which is denoted by a plurality of discrete capacitors and resistors as the representative of the microstructure in the matrix.

It is the eighth object of the present disclosure to characterize a polarized ferroelectric thin film by a hysteresis loop, which plots the polarity of said thin film as a function of the magnitude of in-film electric field.

It is the ninth object of the present disclosure to provide a general design of a corona poling process system for a ferroelectric polymer thin film.

It is the tenth object of the present disclosure to provide a cluster type corona poling process system for a ferroelectric polymer thin film stack having delicate electronic devices embedded therein, such that the electric current meandering on the top surface of the thin film stack will not cause detrimental effect on said devices.

It is the eleventh object of the present disclosure to provide an in-line type corona poling process system for a ferroelectric polymer thin film stack having delicate electronic devices embedded therein, where the transient electric field along the surface of said ferroelectric polymer thin film stack is controlled by the motion speed of the substrate and the magnitude of poling current, such that process parameters falls in a range that is tolerable to the delicate electronic devices.

FIG. 3 schematically depicts the apparatus that will be used to meet the above stated objects. The apparatus will control a corona poling process by the use of measureable quantities (e.g., Barkhausen noise) determined from the system itself as the process is occurring. Moreover, the reliability of these quantities to act as controlling factors is insured by the underlying physics of the polarization process (e.g., the phase changes that accompany the polarization process).

As FIG. 3 shows, a discharge electrode (301) is formed as a plurality of high voltage needles (e.g., 301*a*, 301*b*, and 301*c*, etc.) which forms an array in the upper portion of a corona poling system (300). By using an array of high voltage needles in lieu of a single one as (101) in FIG. 1, the poling current (107) is increased and spread out uniformly in space, and the uniformity of polarity of the poled ferroelectric polymer film is enhanced. Thus, FIG. 3 represents a major improvement of modern corona poling system.

As FIG. 3 also shows, during the corona poling process, a ferroelectric polymer film (3010) is placed on a substrate susceptor (303), which is electrically isolated from the ground (i.e. no current can flow through the susceptor directly to ground). As in the prior art, a conductor grid (302) is placed between the high voltage needle array (301) and the ferroelectric polymer film (3010) in the process chamber/system (300). Along with the array of needles, the presently disclosed corona poling chamber/system (300) differs from the prior art (system (100) in FIG. 1) by the addition of a control system that includes: a Substrate Current Sensor (3011), a High Voltage Needle Array Controller (308), and a Conductor Grid Voltage Controller (309). In practice, these unique features interact with each other to implement a general processing rule to establish a desired poling condition, i.e., Voltage 1A>>Voltage 1B>Voltage 1C>Voltage 2). The following explains their fundamental advantages.

In the beginning stage of the presently disclosed corona poling process, a low poling current (307) is triggered by an initial voltage value of Voltage 1. As Voltage 1 continually increases, poling current (307) will be increased accordingly. When Voltage 1 reaches a predetermined limit value (e.g., Voltage 1B of FIG. 2), it will stop increasing. A stable corona is thereafter formed between the high voltage needle array (301) and the conductor grid (302). As the conductor grid (302) has many openings (holes) in it; some of the charged particles in the corona (e.g., 304) will pass through the grid openings and reach the substrate (3010). When the electrical charges (i.e. poling charge) constituting the poling current (307) arrive at the polymer film (3010), some of them will recombine with charges of the opposite sign on the film surface, the rest will be dissipated over the surface. When these charges contact the susceptor, they will stop moving further in that said susceptor is an isolator. In the present disclosure, we have added a grounding path for these charges (denoted by the switch 3012 being set on the C position). Thus, as FIG. 3 shows, the poling charge flows to the ground through a path created by closing the switch (3012), whereupon it forms a substrate current, i.e. $I_{substrate}$. During the presently disclosed corona poling process, the status of the substrate current ($I_{substrate}$) is continually monitored by a high sensitivity and high resolution sensor (3011); the result can be fed to the respective controllers (i.e. 305, 306) to control the voltage of the high voltage needle array (i.e. 308), and that of the conductor grid (i.e. 309). Still further, there is a process-ending time of the presently disclosed corona poling process whose value is largely determined by evaluation of the Barkhausen nose. With all the above features combined into one controlled corona poling process, the presently disclosed system provides a corona poling process system that can be characterized by (and controlled by) a substrate current with a specific profile, whose slope is largely controlled (i.e. step 804 of FIG. 8) by the voltages of the high voltage needle array (i.e. Voltage 1) and that of the conductor grid (i.e. Voltage 2). As a consequence of such a controlled corona poling process, a high performance ferroelectric polymer film (e.g. one having a strong piezoelectric effect) with excellent longevity is fabricated. Microscopically, this high performance property is attributed to the enriched concentration of β phase crystallite in the matrix; and the improved longevity is the result of the process control (i.e. algorithm 800) implemented by the sensing/monitoring device (3011) and controllers (i.e. 308, 309), which, together, have the capability to automatically identify the process ending point through a determination of the slope of the substrate current. In the following section, we will illustrate the fundamental basis of the high performance ferroelectric polymer film by microstructural analysis.

BRIEF DESCRIPTION OF DRAWINGS

This disclosure will be described with reference to the accompanying drawings, wherein.

DETAILED DESCRIPTION (i) Features Used for In-Situ Monitoring of the Disclosed Corona Poling Process The present disclosure provides what may be called an "intelligent" (i.e., in-situ, process-controlled) corona poling system and a method of its use. Specifically, the process, applied to the basic system of FIG. 3, controls the crystalline structure (i.e. the β phase of PVDF) of a ferroelectric polymer film based on the measurement and analysis of a substrate current rich in Barkhausen noise. By providing a corona poling system including sensor(s) and controllers (i.e. 3011, 308, 309), the voltage of the conductor grid (i.e. Voltage 2) as well as the current emitted from the high voltage needle array (i.e. 3013 of FIG. 3) can be controlled in an in-situ manner.

Figure 1:
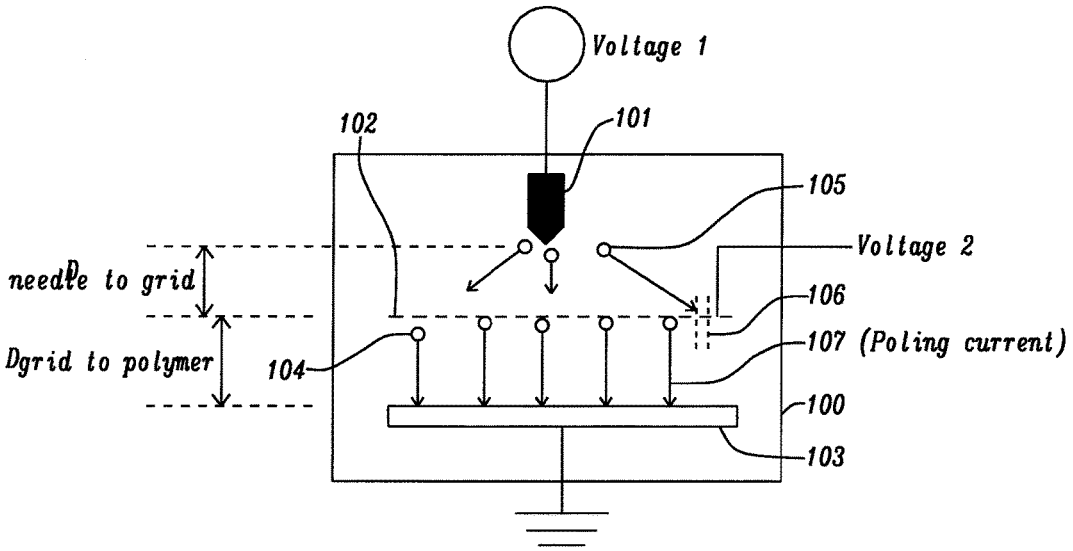
FIG. 1 Prior Art
FIG. 1 schematically depicts a conventional (prior art) corona poling process system.
Figure 2:
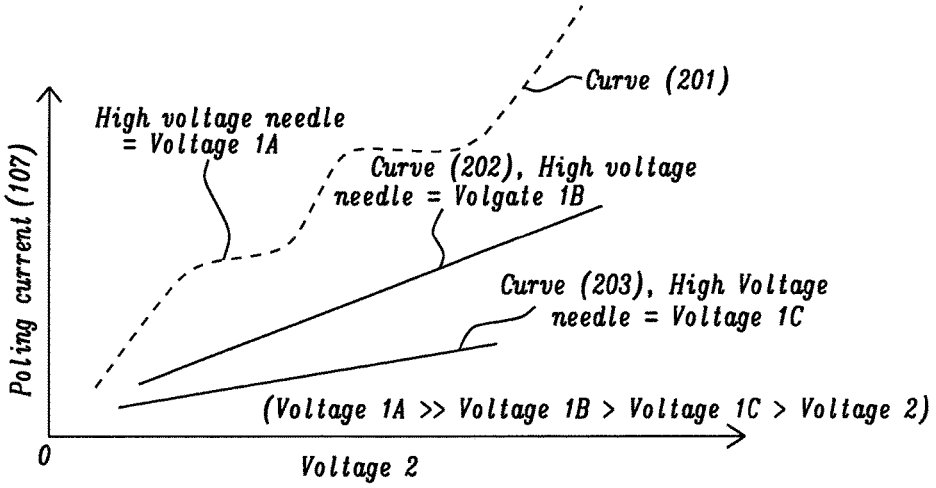
FIG. 2 schematically depicts the relationship between the voltages of the electrodes (i.e. needle and conductor grid) and poling current, in which a non-linearity is manifested when the voltage of the needle is exceedingly high.
Figure 3:
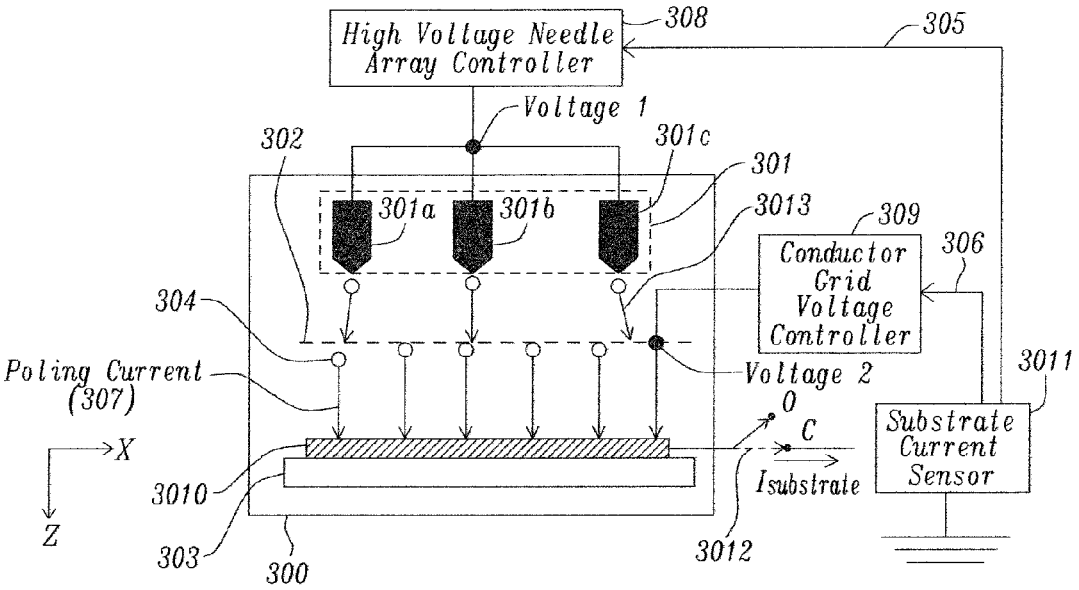
FIG. 3 schematically depicts the presently disclosed corona poling process, which uses several controllers to automatically (using sensor evaluated feedback) adjust the magnitude of the poling current and the voltage of the conductor grid in accordance with the signals input from a substrate current sensor.
Figure 4:
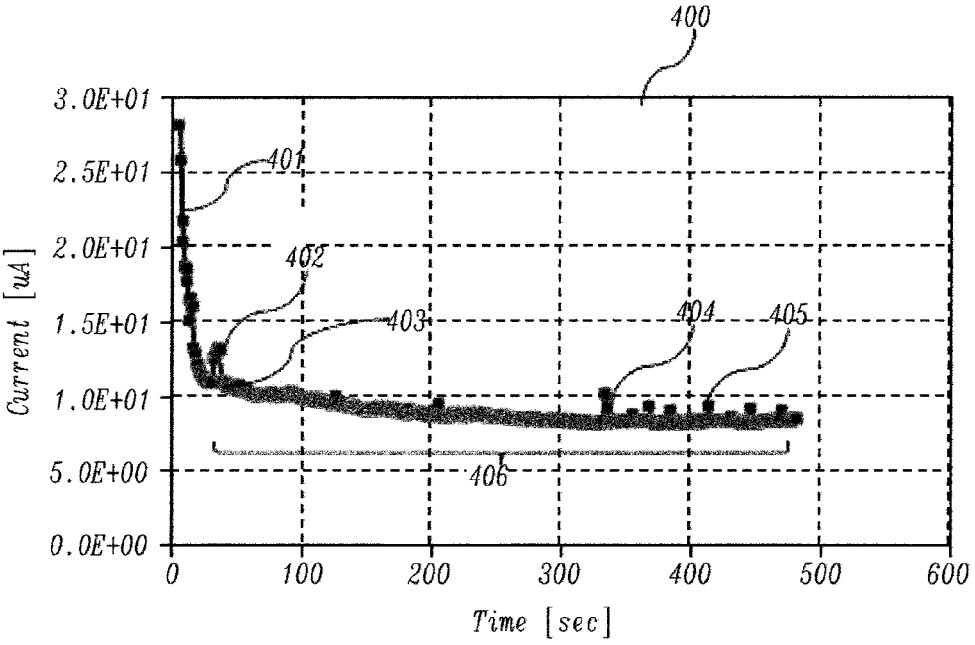
FIG. 4 schematically depicts the poling current of an actual poling process showing changes in slope and oscillation profile indicating current variations due to competition between phase changes and surface and volume charge recombinations.
Figure 8:
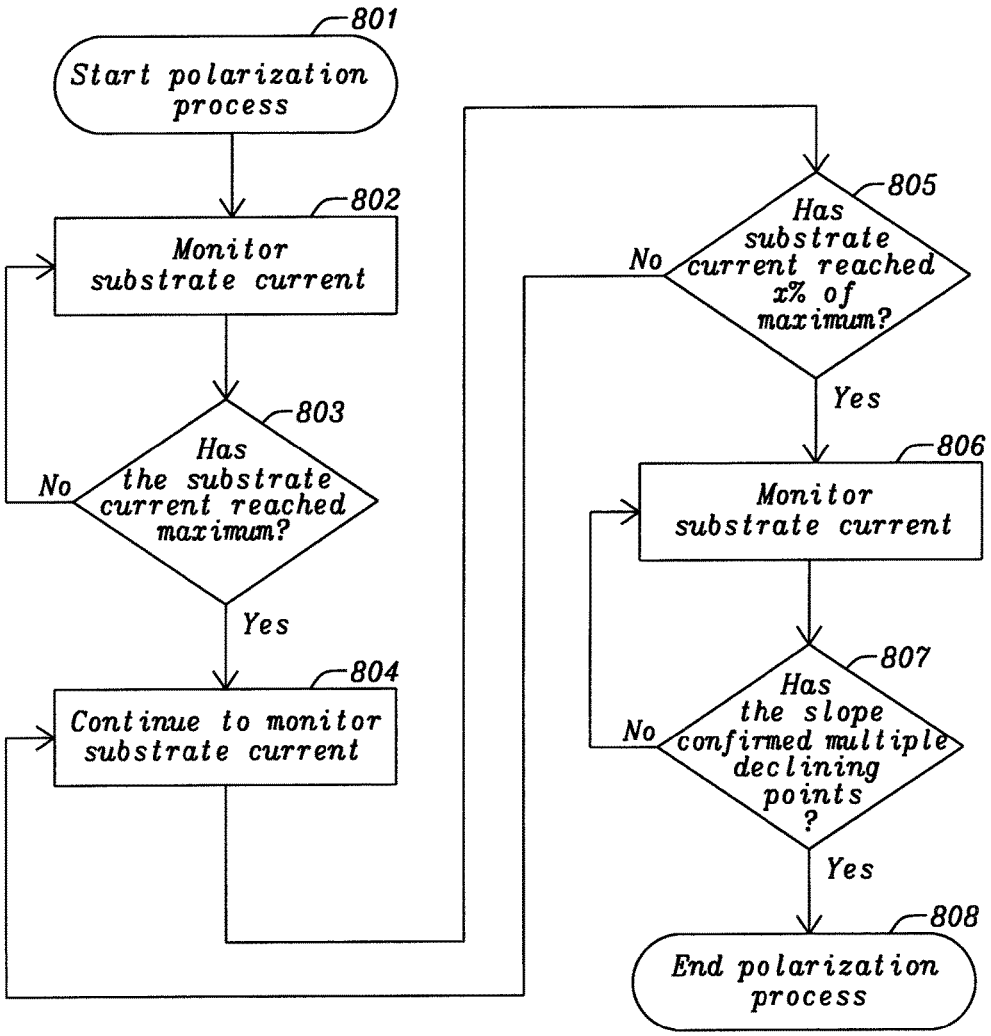
FIG. 8 schematically shows the logical flow chart used by the presently disclosed corona poling system to control the poling process.

Referring now to FIG. 8 and FIG. 3, it is shown that sensor (3011) and controllers (308, 309) interact with each other in response to a control system (800), which is capable of diagnosing the nature and quantity of the Barkhausen noise emitted by a ferroelectric polymer material being subjected to a corona poling process. By the application of such a system (800) to control the performance of the poling process, the condition of the ferroelectric polymer thin film produced by this process can be optimized for performance and longevity. In particular, the sensors/controllers of the system can determine a proper ending point for a corona poling process by monitoring the characteristics of the substrate current. In essence, it is the unique features discussed above that, in combination, support the presently disclosed corona poling process system to produce a high performance ferroelectric polymer film that exhibits the piezoelectric effect to a degree greater than that obtained in the prior art, without suffering from serious aging problems afterwards.

FIG. 8 shows the process flow chart of a system (800) used to control the presently disclosed corona poling system and process (300). This system (800) has several unique features. First, the operation is based on sound physical principles. Using the knowledge acquired from a theoretical study of the nature of the poling process (e.g., determining the magnitude of in-film electric field $E_{in\text{-}film}$ using Eq. (5)), the system (800) enables the poling current/voltage controllers (308, 309 of FIG. 3) to control the magnitude of the poling current (307) in a highly precise manner. During system operation, the input from the system sensors is used to closely monitor the status of the substrate current, i.e. $I_{substrate}$, and feeds the information to the respective controllers via the signal lines (305) and (306). To avoid unexpected non-linear effects on the poling current (307), the voltage of the high voltage needle array (301), i.e. Voltage 1, and that of the conductor grid (302), i.e., Voltage 2, are continually adjusted so that the profile (i.e. slope) of the substrate current ($I_{substrate}$) can be maintained within a specified range. If there is any form of runaway behavior, (e.g., arcing, streamers, etc.), the slope will change its value and the adverse effects will be monitored and controlled. For example, the controller for Voltage 1 can be turned off or reduced in its value instantaneously, so that the poling current (307) will not be further increased. In the meantime, the switch controlling substrate current (3012) can be automatically set to open position (denoted by O in FIG. 3), such that the poling effect caused by the lateral electric field (e.g., in X position of FIG. 3) can be circumvented (the poling process in Z direction will proceed with no perturbation by said "switching off" action, which is desired by the presently disclosed corona poling process).

As a result of the above features, the presently disclosed corona poling system can produce a high performance ferroelectric polymer film in a robust (predictable and repeatable) manner. The essential characteristics of such a high performance ferroelectric polymer can be defined by its enhanced piezoelectric effect and minimized aging problems. Microscopically, these characteristics are produced by an optimized ratio of the concentration of the β phase sub-structure to that of the amorphous sub-structure in the ferroelectric polymer film (e.g., a PVDF). The generation of β phase crystallites produces the bursts of Barkhausen noise in substrate current that are control factors utilized by the system. In the following paragraphs, we will elaborate how they are associated with the substrate current (i.e. $I_{substrate}$ of FIG. 3).

(ii) Generation of Barkhausen Noise in the Substrate Current

Figure 5:
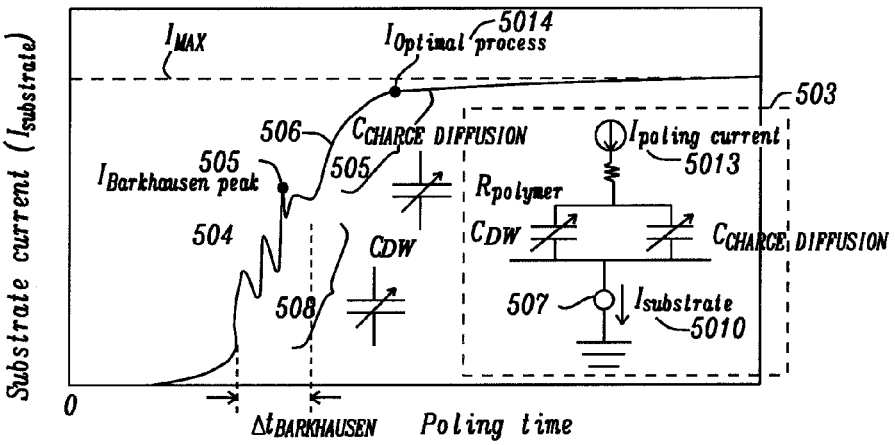
FIG. 5 schematically depicts a typical substrate current profile during the presently disclosed corona poling process; an equivalent circuit loop is also provided.

In this section, we compare FIGS. 3 and 5 to understand how Barkhausen noise is generated. In FIG. 3, it is shown that during a corona poling process, a substrate current (i.e. $I_{substrate}$) is generated when the switch (3012) is closed. FIG. 5 further shows the character of the substrate current (i.e. $I_{substrate}$) throughout the corona poling process (i.e. curve 506). To correlate FIGS. 3 and 5, it is to be noted that $I_{substrate}$ of FIG. 3 corresponds to the substrate current (506) in FIG. 5. Note also that the substrate current (506) has an oscillatory shape (504) in certain segments; such a shape is associated with the domain wall (DW) movement within a ferroelectric polymer film. Specifically, during a corona poling process, each DW-moving event initiates a drastic change of local electrical field, which subsequently causes a spike (e.g., 504) in the substrate current (506). As FIG. 3 shows, using a high sensitivity current/voltage meter (e.g., 3011), one can clearly observe the corresponding oscillatory profile in the substrate current ($I_{substrate}$). This oscillation is the measureable evidence of Barkhausen noise. To illustrate this characteristic clearly, one may use Eqs. (4) and (5) to depict said Barkhausen noise, i.e.

$$\frac{(I_{poling_current} - I_{substrate}) \cdot \Delta t_{BARKHAUSEN}}{\Delta C_{DW}} = \frac{\Delta Q_{Poling_charge}}{\Delta C_{DW}} = V_{BARKHAUSEN} \tag{4}$$

$$\frac{V_{BARKHAUSEN}}{R_{polymer}} = I_{BARKHAUSEN} \tag{5}$$

where $I_{poling_current}$, $I_{substrate}$ $C_{DW}$, and $R_{polymer}$ are the poling current (307), substrate current, capacitance of domain walls, and resistance of the skin of ferroelectric polymer film (i.e. (3010) of FIG. 3; it can be generated by charge recombination effect), respectively. Note that the duration of each spike of the Barkhausen noise (e.g., $V_{BARKHAUSEN}$) is very short (e.g., nano-sec), Barkhausen noise is a terminology originated from Physics. In solid-state physics, the amplitude of a Barkhausen noise (either in current or voltage mode, i.e. $I_{Barkhausen}$ or $V_{Barkhausen}$ of Eqs. (4) and (5)) of a ferromagnetic material (e.g., ion) has been confirmed having to do with the grain size, stress condition of the bulk material, temperature, precipitates, segregation, impurities, etc. However, a comparable level of understanding on ferroelectric polymer material is still lacking today.

(iii) Characteristics of Substrate Current Throughout a Poling Process

It has been empirically determined that during the corona poling process of a ferroelectric polymer material such as a PVDF, the amplitude of the Barkhausen noise (either in current or voltage mode, i.e. $I_{Barkhausen}$ or $V_{Barkhausen}$) will increase initially; then, after it has passed through a maximal value, the magnitude of the Barkhausen noise will decrease to a lower but stable value.

Based on our understanding of solid-state physics, the instantaneous rise of the substrate current (504) is associated with the phase transformation process (e.g., from the α to β phase of PVDF) of the ferroelectric film material. When the phase transformation process is complete, the major portion of the substrate current (506) will largely be contributed by the diffusion process of trapped charges. Because of the complex relationship between the two mechanisms, the character of the substrate current (506) in a corona poling process is often considered "black magic" to many process engineers. Thus, there has been a desire for the industry to develop an understanding of when/how the substrate current (506) changes in accordance with the status of the poling process of a ferroelectric polymer material. In this regard, we can now say that an understanding of Barkhausen noise can play a vital role. If a degree of intelligence (i.e., feedback control) can be added to a corona poling current controller based on the understanding learned from the above, an equally "intelligent" corona poling system can be constructed that meets the objects set forth above. Without this feedback-control feature based on an understanding of Barkhausen noise, conventional (prior) art (as exemplified by the present ferroelectric polymer industry) has no effective means to optimize the properties of a ferroelectric polymer thin film easily (e.g., piezoelectric effect, polarity, grain size, etc.).

Since a fully developed theory of how the Barkhausen noise in a ferroelectric polymer material is generated is still not totally clear, the present disclosure takes another route to meet the challenge. By applying certain knowledge learned from physics, we can obtain a reasonable grasp of how the Barkhausen noise in a crystalline structure such as PVDF thin film evolves. Nevertheless, there are still fundamental differences between polymer physics and classical solid-state physics. In a matrix made of ferrous material, its grains are all constructed by the solid phase microstructures (e.g., iron based grains). As to the ferroelectric polymer material, such as a PVDF thin film being poled at a processing temperature higher than its Curie temperature, e.g., 80° C., its microstructure comprises crystals, amorphous substructure, molten or even half-molten ingredients. In a ferrous material, Barkhausen noise can be analyzed relatively straightforwardly (i.e. the parasitic capacitance does not change much in a B—H hysteresis loop). In a ferroelectric polymer material, however, Barkhausen noise will involve far more complicated issues (e.g., the discrete capacitance $C_{DW}$ and $C_{CHARGE\ DIFFUSION}$ may change their respective values during the course of a corona poling process). Thus the corresponding means of diagnosing Barkhausen noise in ferroelectric polymer material, requires substantial knowledge of both chemistry and physics. Hindered by such a limitation, as of today, the generation of Barkhausen noise by a ferroelectric polymer material can only be taken as a "rough" indication by the scientists to "characterize" the condition of crystallization of such material in a "ball-park" manner. In essence, there is literally no quantitative mechanism for the polymer industry to take the full advantage of Barkhausen noise to optimize the performance of a ferroelectric polymer material effectively.

As we have indicated, the present disclosure closes the above gap; it uses two physical concepts, i.e. coercivity and squareness, to help a unique algorithm (800) control a corona poling process comprehensively. Specifically, by utilizing the knowledge learned from a substrate current (e.g., 506) that is mixed with Barkhausen noise (e.g., 504), the crystallinity of a ferroelectric polymer material can be monitored and even optimized, by the presently disclosed corona poling process.

(iv) Characteristics of Barkhausen Noise in a Ferroelectric Polymer Thin Film

Figure 6A:
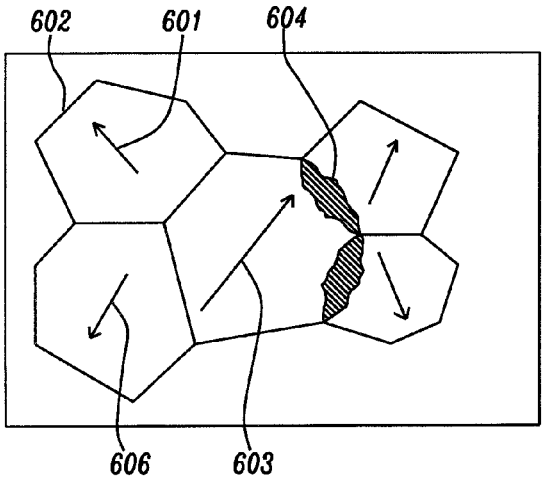
FIGS. 6A and 6B schematically depict the directions of the domains in a ferroelectric polymer thin film before and after it has been poled.
Figure 6B:
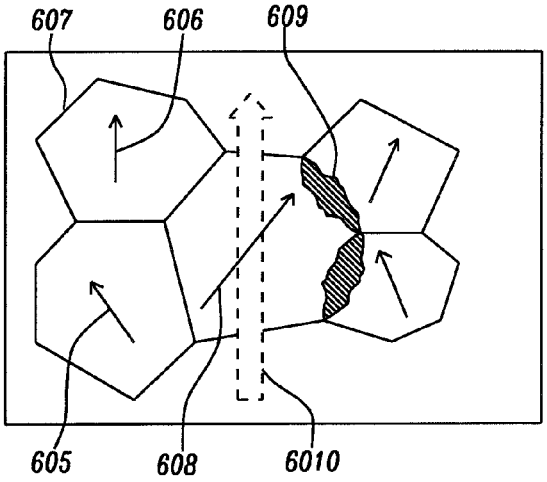

In section (ii), we have explained that Barkhausen noise occurs mainly from the activity of the domain walls (DWs). FIGS. 6A and 6B schematically show the typical microstructures of a ferroelectric polymer material having these domain walls (in this case, we use PVDF as the specimen, but other materials can be used as well). Note that there are quite a few microstructures that can form the crystalline structures in a ferroelectric polymer material; the domain walls (e.g., 602) and amorphous structure (e.g., 604) are only the two dominant ones.

Theoretically, any factor that can influence the movement of domain walls (e.g., 602) will affect the Barkhausen noise. For example, Barkhausen noise can be affected not only by the in-film electric field $E_{in\text{-}film}$, but also the stretching condition (e.g., the direction and magnitude of the stress), the relative ratio of the concentration of copolymer to that of PVDF, the processing temperature, etc. Take FIGS. 6A and 6B as the examples. Before a ferroelectric polymer material is poled (i.e. as in FIG. 6A), the directions of the respective domains indicate (e.g. arrows 601, 603, and 606) that their polarities are directed randomly. This leads to a zero net polarity of the bulk material as in FIG. 6A. After the ferroelectric polymer material has been poled, as FIG. 6(B) shows, the polarities of the respective domain walls (denoted by 605, 606, and 608) are re-aligned in a more unified direction (denoted by the large arrow in dashed lines (6010)), which results in an enhanced polarization of the bulk material. Note that the changes of directionality of each domain also corresponds to a displacement of charges in the ferroelectric polymer material. We can envision this in FIG. 5. During the course of the corona poling process, there will be a plurality of intermediate spikes (e.g., 504, etc.) in the substrate current (506). In practice, the substrate current (506) represents composite data that combines the electrical current induced by charge displacement due to domain wall movement (508) and the trapped charge diffusion process (i.e. 505). It is to be noted that these two types of currents are happening concurrently, particularly when the Barkhausen noise is at its peak. Thus, while the spikes (504) are being generated, the charges trapped in the amorphous structure (e.g., 604, 609) are also being simultaneously moved by the in-film electric field. The contribution of the two types of current may gradually change over an entire poling process; the whole history of polarizing a ferroelectric polymer material (denoted by curve (506) in FIG. 5) could be divided into several segments (e.g., 505, 508), but the microstructures may be so well blended into the matrix that distinct differences among the respective segments in the substrate current (506) may not always be discernable. To cope with this problem, a process engineer can resort to analysis of the hysteresis loop and kinetic theory to fully characterize a corona poling process. We will discuss the utility of the hysteresis loop by FIGS. 7(A) through (D), which are the envisioned plots generated based on physics theory and practical experience.

Figure 7A:
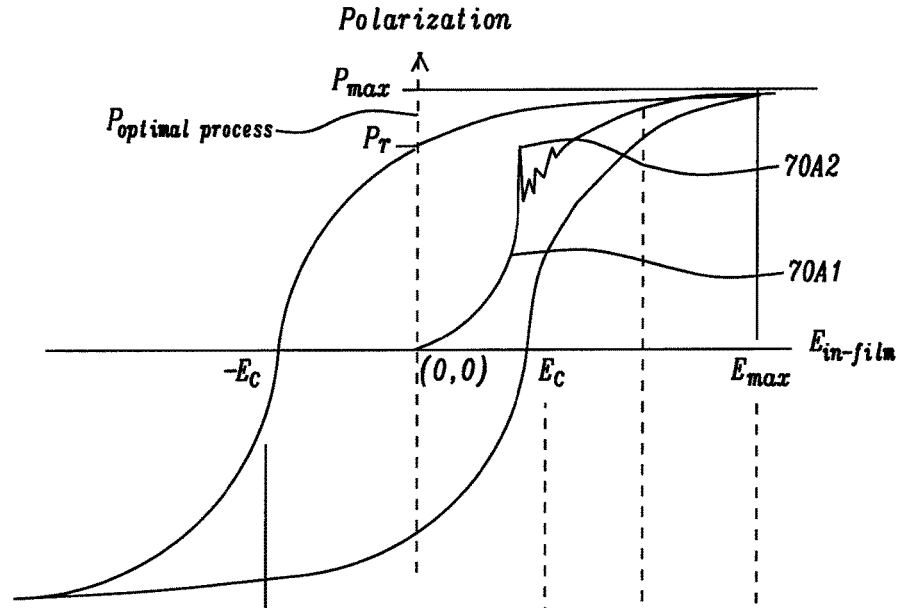
FIGS. 7A through 7D schematically depicts a hysteresis loop (i.e. polarity vs. in-film electric field) and the corresponding substrate current of a ferroelectric polymer thin film (e.g. PVDF) under a poling process.

As FIG. 7(A) shows, when a poling process just begins (i.e. $E_{in\text{-}film}<E_c$), the polarization of a ferroelectric polymer material under nominal situation (i.e. the curve denoted by 70A1) will increase in compliance with the increased magnitude of the in-film electric field. In this stage, $E_c$ denotes an upper limitation for a process engineer to polarize a ferroelectric polymer by an in-film electric field without worrying causing side effects (e.g., non-linear effects in polarization can be caused by too strong an in-film electric field). In a controllable situation (i.e. $E_{in\text{-}film}<E_c$), as Eq. (3) shows, the magnitude of an in-film electric field $E_{in\text{-}film}$ can be assumed linearly dependent on the voltage of the conductor grid (i.e. Voltage 2; provided the thickness of said polymer layer is not changed and we have deposited ample amount of charges on said polymer). Therefore, we can control the value of Voltage 2 as an effective means to polarize a ferroelectric polymer. In the present disclosure, we have developed a unique algorithm (800) that controls Voltage 2 and the other processing parameters automatically.

From the previous paragraphs, we have understood that the Barkhausen noise emitted by a ferroelectric polymer material is strongly related to the movement of the domain walls. As an example, such a movement can be denoted by arrow (606); arrow (606) is changed to arrow (605) after the host ferroelectric polymer materials in FIGS. 6A and 6B has being poled. As FIGS. 7(A) and (B) further show, Barkhausen noise has many things to do with the net polarity of a bulk material (denoted by the vertical axis of FIG. 7A). In the following paragraphs (i.e. (a), (b), and (c)), we will elaborate the relationship between the net polarity of a bulk material, its microstructure, and the Barkhausen noise of a ferroelectric polymer material. After the relationship among these parameters have been explained, we will discuss the process elements that use the Barkhausen noise to control the microstructure and thereby, the final properties of a ferroelectric polymer thin film (i.e. number (5) of section (v)).

(a) Role of Phase Transformation in Barkhausen Noise

Figure 7B:
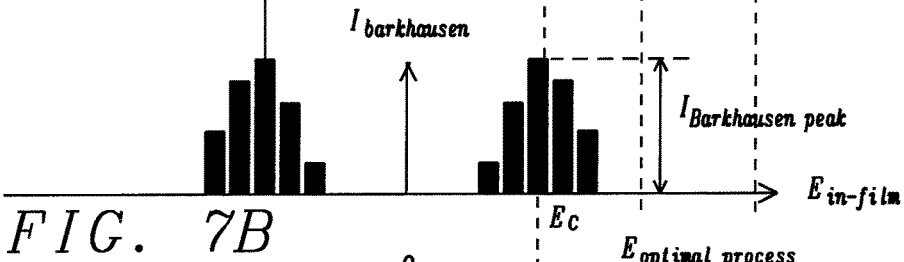
Figure 7C:
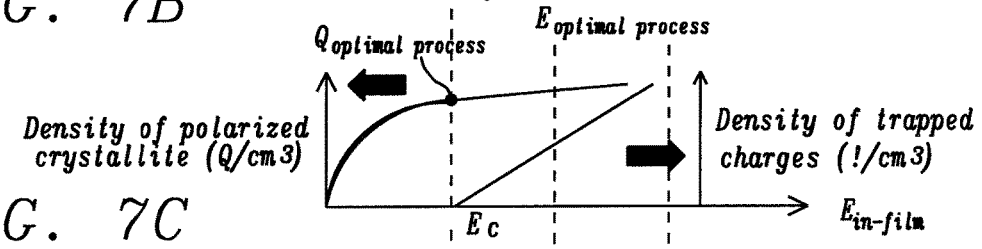
Figure 7D:
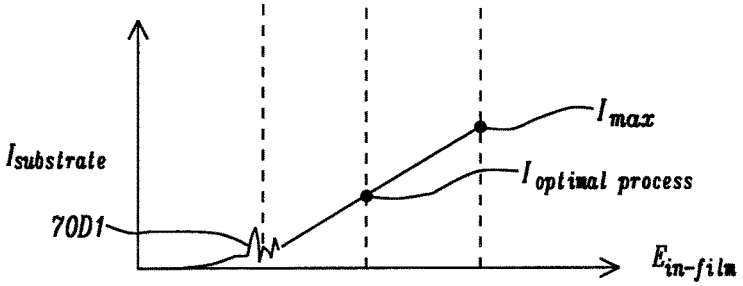

As FIGS. 7(A), 7(B), and 7(C) show, throughout a corona poling process, there is a phenomenon which is common to almost all ferroelectric polymer materials (e.g., PVDF)—at the moment the Barkhausen noise reaches its climax (denoted by 70A1), the majority of the α phase grains are transformed to the β phase (denoted by the plateaued density of polarized crystallite in FIG. 7C). The amplitude of the Barkhausen noise signifies a situation that the essential property (i.e. piezoelectric effect) of the ferroelectric polymer material being poled has been established then. If said corona poling process proceeds relentlessly (i.e. the magnitude of said in film electric field continues to increase), the remnant α phase will be further transformed; and, as the consequence, there will be fewer and fewer α phase left in the matrix for said transformation. Under this circumstance, the amplitude of said Barkhausen noise will be gradually decreased (Denoted by the reduced height of Barkhausen noise in FIG. 7(B), i.e., $I_{Barkhausen}$ after it has passed the climax, i.e. $I_{Barkhausen\ peak}$).

(b) Role of Grain Growth in Barkhausen Noise

It is common knowledge in materials science that the total grain boundary area of a thin film system will be decreased when its grains grow larger. By the same token, when the domains (i.e. clusters of grains) of a ferroelectric polymer material grow larger and larger during a corona poling process (often caused by thermal energy), the total area of the domain walls available for the Barkhausen noise to take place will be decreased accordingly. If one still wants to transform more α phase grain to β phase, he/she may resort to an elevated substrate temperature, whose general rule is depicted by the following empirical equation, i.e., $$J_{max} = J_0 \cdot E_{in\text{-}film}^{n} \cdot \exp\left(\frac{-E_a}{k_B T}\right) \tag{6}$$

where $J_{max}$ denotes maximal current density, n denotes the effectiveness of an in-film electric field, $E_{in\text{-}film}$; $J_0$ is a proportionality constant that usually has to do with the initial amount of the particular phase crystallite available for phase transformation, T is the process temperature, $k_B$ is the Boltzmann constant, and $E_a$ is the activation energy of causing said domain wall movement. As was reported by prior art, a typical value of $E_a$ is 0.65 eV for PVDF.

Thus, when we compare the result of Eq. (6) to FIG. 5, we may notice that there lies a value (i.e. $I_{max}$) of the substrate current (506) that, by context, denotes the completion of said α to β phase transformation. Hence, by monitoring the magnitude of the substrate current (506) via an in-situ manner, the presently disclosed corona poling system can decide when to end a process without over doing it. Note very carefully that there is another point on said substrate current (506), i.e. $I_{optimal\ process}$—as has been explained earlier, while the spikes (504) of phase transformation are being generated, there are extra charges trapped in the amorphous structure (e.g., 604, 609) being moved by said in-film electric field, the electrical current caused by said charge transportation process denotes the charge diffusion current. An optimized corona poling process would want the value of $I_{optimized\ process}$ as high as possible, whereas the point of ending a poling process is desired to be as close to $I_{optimized\ process}$ as possible.

During the course of a typical corona poling process (i.e. poling by an in-film electric field), as one may be acknowledged by Eq. (6), a substrate current will be increased when a substrate is heated (e.g., to several tens of degree C.). The combined effect of said in film electric field and thermal energy on a corona poling process is discussed in the following paragraph.

Generally speaking, a corona poling process for ferroelectric polymer material would prefer its process temperature to be relatively high (e.g., T>80° C. for PVDF), so that the associated phase transformations can be completed more easily (i.e. the poling process is in fact a combination of electric field and pyro-poling one). On the other hand, when a poling process temperature goes too high (e.g., T>Curie temperature of PVDF crystallite, say, 205° C.), different side effects may take place in the ferroelectric polymer material (e.g., unnecessary charge generation, depolarization, diffusion, etc.). To cope with these problems, the presently disclosed method sets the substrate temperature between 60 degrees C. and 100 degrees C. and monitors the Barkhausen noise in an in-situ manner. As has been disclosed in the earlier portion of the present disclosure, when the crystalline structure of a ferroelectric polymer material is experiencing dipole polarity changing, there will be spikes (e.g., signal (70A1) in FIG. 7(A)) in the substrate current (i.e. Barkhausen noise). As explained by solid-state physics, at the time the Barkhausen noise reaches its highest magnitude, the movements of the domain walls reach a maximum and the corresponding in-film electric field can be denoted as the coercivity ($E_c$) of said ferroelectric polymer material.

When multiplying the coercivity of the ferroelectric polymer material ($E_c$) and the maximal polarity of the ferroelectric polymer material (i.e. $P_{max}$ of FIG. 7A, the product denotes an area enclosed by the corresponding hysteresis loop, which is related to the energy required to make this situation happen. When the value of said product is larger, it denotes that the energy required for poling said ferroelectric polymer material is higher, and vice versa. So, as a rule of thumb, in order to achieve a strong piezoelectric effect, a process engineer would like to pole a ferroelectric polymer material with the value of coercivity ($E_c$) and the maximal polarity ($P_{max}$) as large as possible.

(c) Barkhausen Noise as a Combined Effect of Phase Transformation and Grain Growth As Eq. (6) depicts, adding in-film electric field $E_{in\ film}$ to a ferroelectric polymer substrate while heating it to an elevated temperature T can cause a combined effect on the substrate current. In practice, a process engineer can manipulate the profile of a substrate current by using both parameters. As an example, FIG. 7(B) shows a typical profile of Barkhausen noise; it reaches the maximal value at a specific in-film electric field denoted by $E_c$ (i.e. coercivity). FIG. 5 shows a similar phenomenon that happens to the substrate current (506) from different perspective. At a certain poling time, the Barkhausen noise (505) reaches its maximal amplitude. As one can envision, on a typical substrate current curve (506), there lies a process ending point, i.e. $I_{optimal\ process}$. In FIG. 5, the location of said $I_{optimal\ process}$ can be extrapolated from $I_{Barkhausen\ peak}$ ((505); e.g., X % larger than that of $I_{Barkhausen\ peak}$, the parameter X is an arbitrary number determined by the process engineer by experience).

We may take the above data from the hysteresis loop of a ferroelectric polymer thin film for better visualization of a corona poling process. That is, when a corona poling process goes beyond $E_c$ (e.g., to a point denoted as $E_{optimal}$ in FIG. 7 B), the ferroelectric polymer thin film reaches its optimal performance (e.g., piezoelectric effect); upon that situation, its polarity value is denoted by $P_{optimal\ process}$. Like the substrate counter-partner, the location of the $E_{optimal}$ on the horizontal axis of FIG. 7(B) can be extrapolated from $E_c$ (e.g., Y % larger than that of $E_c$, the parameter Y is determined by the process engineer by experience).

Using the methods above, the presently disclosed corona poling system devised an algorithm (800) to calculate the maximal in-film electric field required for poling a specific ferroelectric polymer thin film. This algorithm (800) applies the fact that any in-film electric field ($E_{in\text{-}film}$) higher than $E_{optimal}$ is unnecessary, since the extra polarity gained by such a redundant electric field will be degraded in time (i.e. the aging problem) as a result of recombinations with the other charges on the polymer surface. In section (v), we will elaborate the merits of the algorithm (800) in terms of preventing aging problems.

(v) Aging Problems Caused by the Redundant Charges on an "Overly Poled" Polymer

If a corona poling process continues beyond said "process end-point" (i.e. $I_{optimal\ process}$ of FIG. 5), the crystalline structure available for creating phase transformations (e.g., from α to β) will eventually be used up. As FIG. 7(A) shows, such a phenomenon causes the remnant polarity of a poled ferroelectric polymer thin film to increase slightly higher (i.e. vertical axis of FIG. 7(A), i.e. from $P_{optimal\ process}$ to $P_{max}$). In reality, the fundamental reasons for causing the slight difference between the two polarity values (i.e. $\Delta P=P_{max}-P_{optimal\ process}$) can be attributed to various reasons, such as amorphous structure, co-polymer content, segregation, impurities, etc. The redundant charges were driven to the surface of the polymer thin film by the exceedingly large in-film electric field. In a typical substrate current curve such as (506), the segment that has to do with the diffusional process of trapped charge is (505); in this segment, the current caused by trapped charge diffusion process is like a DC one. Since the population of said trapped charges in a bulk material will be increased in accordance with the increased magnitude of said in-film electric field, said DC current will cause an augmented effect on the apparent polarity of said ferroelectric polymer thin film. However, as soon as said in-film electric field is removed (i.e. Voltage 2 shuts off), said apparent polarity will start to degrade (the redundant charges will be recombined with the other charges on the polymer surface easily). Hence, what those redundant surface charges actually denote is an extra polarity ($\Delta P=P_{max}-P_{optimal\ process}$) caused by a a reversible process (contrary to the irreversible process caused by phase transformation), which may lead to the deterioration of a ferroelectric polymer thin film material (e.g., retrograded piezoelectric effect) over time (i.e. aging).

In a substrate current (506), the segment that really represents the above stated irreversible process (i.e. none-aging crystallite) is the zig-zag one (508; generated by phase transformation); in the equivalent circuit loop model, such a zig-zag current acts as an AC signal superimpose on a DC one. Together the above two types of electrical currents (i.e. current caused by phase transformation and trap charge diffusion) combine to form the total substrate current (506) as a process engineer measured in a typically corona poling process. In FIG. 8, the presently disclosed algorithm (800) determines a value of substrate current (i.e. step 805) that signifies the end of a corona poling process; this value is really extrapolated from (e.g., X % higher than that of $I_{Barkhausen\ peak}$ (505)) the above stated DC+AC current.

As FIG. 7 (C) shows, at $E_{in\ film}=E_c$, the density of polarized crystallite ($Q/cm^3$) in a ferroelectric polymer thin film reaches its knee point, which is denoted by $Q_{optimal\ process}$. In FIG. 7(D), the substrate current profile shown in the corresponding area shows a zig-zag profile, which is denoted by 70D1. As one may notice, at point 70D1 (i.e. the Barkhausen noise reaches its climax), the in film electric field $E_{in\text{-}film}$ reaches $E_c$, the coercivity. As FIG. 7(B) shows, at this stage, the total amount of α phase crystallites available for transformation starts to decline. However, as FIG. 5) shows, it will take some more processing time reach the optimal condition ($I_{substrate}=I_{Optimal\ process}$ (5014)), on which said α phase crystallites are totally depleted.

(v) Using an Intelligent Process Control System (800) to Harness the Fundamental Property of a Ferroelectric Polymer Thin Film In the former section, we have explained that during a typical corona poling process, the substrate current (506) has contributions from the current caused by phase transformations (508) and the current caused by charge diffusion (505). But we have not yet provided any guidelines for a process engineer to harness the fundamental property of a ferroelectric polymer thin film. This section closes the gap by providing the above stated guidelines in a comprehensive manner.

In FIG. 8, the presently disclosed corona poling system provides an intelligent process control system (800) to monitor and evaluate the substrate current-time slope (i.e. step 806 and 807) during a corona poling process. By "intelligent process control" is meant the use of sensors that monitor the status of the system and, through mathematical analysis of the sensor data by elements of the system itself, often by the internal hardware implementation of a mathematical algorithm, evaluating the status and providing continual feedback to the control mechanisms of the system. Use of the term "algorithm" in this context is meant the particular steps applied in the implementation of mathematical analysis of sensor data to meet such objects of the process as its optimization and the determination of a process end time. This is one of the essential features that make the presently disclosed corona poling system a truly unprecedented one.

To optimize a corona poling process, one can heat up the substrate while adding an in-film electric field to the ferroelectric polymer thin film, or, one can stretch the ferroelectric polymer thin film. When the in-film electric field, stress, and thermal energy jointly pole a ferroelectric polymer film, the activation energy of Eq. (6) would have to be changed to Ea' i.e.

$$E'_a=E_a-\lambda\cdot\sigma \tag{7}$$

where λ is a proportionality constant and σ is the stress being applied onto said ferroelectric polymer thin film material.

In a corona poling process, it is the parameter n of Eq (6) that has to do with the non-linear effect (i.e. n>1) of a ferroelectric material being poled. When the value of n is close to one, the above stated maximal current density, $J_{max}$ of Eq. (6), complies with a linear relationship with the magnitude of said in-film electric field. In practice, the magnitude of n can be verified by the presently disclosed corona poling system. That is, algorithm (800) may plot the substrate current (506) versus the voltage of the conductor grid (i.e. Voltage 2) in its memory automatically. An optimal grid voltage for poling a ferroelectric material at a specific process temperature and a specific stretching condition shall render an n value close to one, but other numbers that may cause a non-linear effect within the range of process tolerance is also permissible. The realistic value of n can be found out in the initial steps of a poling process; alternatively, a process engineer can set certain values for it as a default number. Once that n value is determined, the above stated plot of the substrate current (506) versus voltage of the conductor grid (i.e. Voltage 2) can define a desired slope of substrate current for a specific ferroelectric polymer thin film material. Thus, as FIG. 8 shows, in step (806) and (807), the presently disclosed algorithm (800) can investigate the slopes of the rising and declining segments of the substrate current (the declining segment denotes the substrate current measured after the poling current is turned off). The result should provide a process engineer with comprehensive information about how a ferroelectric polymer thin film is being, or has been, poled.

Of course, as the corona poling process proceeds, there are other values of n that can join the pay; this is because the microstructure of a ferroelectric polymer thin film is a really composite one. Inside a ferroelectric polymer such as PVDF, there may be different types of crystals that have different dielectric constant, defect density, etc. Still further, the transportation mechanisms associated with the trapped charges may also vary in different ferroelectric polymer materials. With all these being said, we still maintain what has been explained in the former paragraphs—Barkhausen noise takes place mostly at the DWs (namely, the grain boundaries of the PVDF matrix). Thus, as a recapitulation, this is really what we want to accomplish for the presently disclosed intelligent poling process—phase transformation. In the presently disclosed system, algorithm (800) is acknowledged the higher peak amplitude of the Barkhausen noise ($I_{Barkhausen\ peak}$ of FIG. 7(B)), the higher quality of the ferroelectric polymer material will be, and vice versa.

Using a hysteresis loop to characterize a corona poling process provides a new perspective on a poled ferroelectric. The subtle differences between a decent polarization (i.e. Polarization=$P_{optimal\ process}$) and that of an overly poled one (e.g., Polarization=$P_{max}$) can be analyzed by the presently disclosed method. Using a hysteresis loop to analyze a corona poling process is nothing new to the conventional ferroelectric polymer industry. What the conventional industry has not discovered is that when the magnitude of said in-film electric field (i.e. the X-axis of FIG. 7) reaches a specific value denoted as coercivity ($E_c$), the amplitude (both in voltage and current signal) of the Barkhausen noise ($I_{Barkhausen}$) reaches its highest value (i.e. $I_{Barkhausen\ peak}$). The data $E_c$ derived from that incident serves as the inflection point of the entire corona poling process. As FIG. 5 and FIG. 8 show, once the location of $I_{Barkhausen\ peak}$ (505) is identified, algorithm (800) can determine the process ending point (i.e. $I_{optimal\ process}$ (5014)) automatically; this feature can prevent the redundant charges in the bulk material from moving to the surface any further. FIG. 5 is a plot of substrate current vs. time. As a further enhancement of the fundamental capability of the presently disclosed corona poling system, algorithm (800) can set up an upper limit of said substrate current and then check it timely during a poling process; in FIG. 8, this feature is implemented by the step (802), (803), and (804), respectively.

(vi) Investigate the Squareness of a Ferroelectric Polymer Thin Film by Investigating the Slope of Substrate Current as it Decreases If one analyzes the hysteresis loop in further detail, it can be seen that the amount of the trapped charges on the surface of the polymer is associated with the polarity of the poled ferroelectric polymer material, e.g., $P_{max}$. Upon the completion of a corona poling process, the voltage of the conductor grid (i.e. Voltage 2) will be turned off; thus, $E_{in\text{-}film}$ will be decreased to zero. Whenever this happens, the work function of the mobile charges on the surface of the polymer material (they were changed by said Voltage 2 when the poling current is turned on) will return to its original level—one that is full of recombination sites, etc. As the consequence, the extra charges on said polymer surface will eventually be recombined with the traps of the opposite signs. As a consequence, after Voltage 2 is turned off, the remnant polarity of the poled polymer material will be decreased to a lower value, i.e. $P_r$ ($P_r<P_{max}$).

In Physics, the ratio of $$\frac{P_r}{P_{max}}$$

is referred as the squareness of a hysteresis loop. That is, when $$\frac{P_r}{P_{max}} \approx 1,$$

the corresponding hysteresis loop will appear more like a square, and vice versa. As one can understand from FIG. 7(A), a ferroelectric polymer material with a high squareness value will suffer less aging problem (i.e., less surface charge recombination effect). Hence, a polarized ferroelectric material with high squareness value will have a piezoelectric effect stronger than that of the one having lower squareness value. The challenge is to find a method by which the effect of recombination can be analyzed. The substrate current provides the clue for this. In practice, one can investigate the slope of the substrate current when Voltage 2 is turned off And this is exactly what the step (807) of algorithm (800) is intended to accomplish.

In the prior art, designating a specific value of squareness to a ferroelectric polymer material is very difficult in that there is no effective way for a process engineer to determine the position (i.e. a specific value) of coercivity ($E_c$) in a hysteresis loop like FIG. 7(A), and the industry has not acquired comprehensive knowledge in substrate current. From the present disclosure, we now understand that this coercivity ($E_c$) denotes when the phase transformation process reaches its climax (i.e. from phase $\alpha$ to $\beta$); we also learn how a substrate current is constituted by the composite microstructure of a ferroelectric polymer thin film.

As FIG. 7A shows, from that $E_c$ point one can derive a fair expectation on the value of $P_{optimal\ process}$. In the meantime, the corresponding substrate current, i.e., $I_{optimal\ process}$, can also be determined. Note carefully when we are measuring $E_c$, Voltage 2 must be turned on (i.e., work function of the charges on polymer surface is far from the energy level of traps), so that there is no recombination effect contributing to the respective values. Supported by the knowledge of the content in a substrate current caused by recombination effect, the process control system (800) can estimate the aging property of a ferroelectric polymer thin film after it has been polarized (step 807). As of such, a high performance ferroelectric polymer material with its squareness value adjustable by process engineer can be fabricated.

To briefly summarize, the present disclosure has the advantageous ability to:

(1) Polarize a ferroelectric polymer thin film by a corona processing system that incorporates poling current, needle array voltage, grid bias, substrate temperature, stretching condition (optional), and process controls and devices that determine a process ending time automatically.

(2) Use intelligent process control (i.e. by implementation of algorithm 800), to monitor the poling process of a ferroelectric polymer material through the substrate current, such that the crystallinity of a polarized thin film material (e.g. α phase crystallite in the matrix) can be controlled in an in-situ manner.

(3) Combine the concept of hysteresis loop and knowledge in microelectronics (e.g. charge recombination), to generate an intelligent process (i.e. process control algorithm 800) to assess the impact of defects, traps, or other charge recombination centers, etc., on the fundamental performance of an electronic device using ferroelectric polymer thin films (e.g. aging).

(4) Harness the fundamental property (e.g. aging, piezoelectric effect, remnant polarity, etc.) of a ferroelectric polymer material via an in-situ monitoring process of substrate current. For example, a process engineer can adjust the processing temperature (e.g., lamp heating a substrate) of the presently disclosed corona poling process for various purposes. Process temperature may cause different effects on a ferroelectric polymer material. A higher processing temperature may have a positive influence on phase transformation (e.g. From α to β); but it has a price to pay for—the density of the trapped charges will be increased as well, and this will lead to the aggravated surface charge recombination effect. Associated with substrate current sensor (3011) and implementation of algorithm (800), the presently disclosed corona poling system could help a process engineer harness the fundamental property of a ferroelectric polymer material.

It should be noted that although the present disclosure is directed to an intelligent corona poling process for ferroelectric polymer thin film, there are other utilities and functions (e.g. semiconductor device, non-volatile, memory, etc.) that can be derived from the disclosure herein described that can be adopted by the electronic devices such as organic field effect transistors, adaptive control system of robotics, organic nonvolatile memory, etc.

Figure 9A:
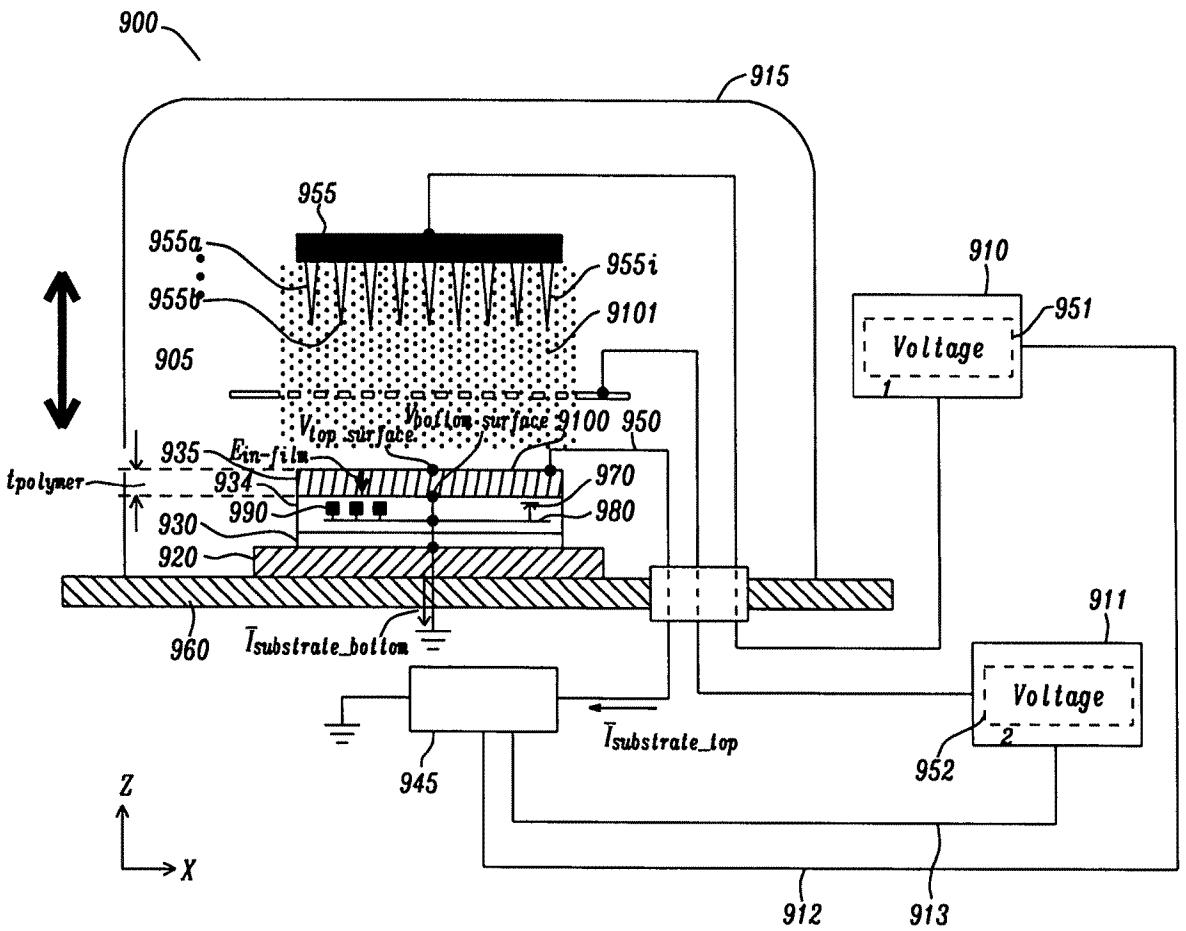
FIG. 9A schematically depicts a generic system platform that can be adopted by a general single substrate research system, a cluster system, or an in-line system.

5. A Robust Corona Poling Chamber/System for Application of the Present Process to a Ferroelectric Polymer Thin Film FIG. 9A schematically describes a corona poling system (900) and associated process that will meet the objects of this disclosure. As FIG. 9A shows, the corona poling system comprises a platform (960), a substrate holder/heater (920), a high voltage needle array (955) and a conductor grid (905). As an optional feature, the substrate holder/heater (920) may include a heating element and/or a temperature sensing device.

Upon beginning the corona poling process, a substrate (930) is loaded onto the substrate holder/heater (920) which in this example is a plate coated by a ferroelectric polymer thin film material (935). The substrate may optionally include a delicate electronic device layer (934). When the substrate (930) reaches a predetermined temperature designated by the specific process being performed, the poling system (900) is ready for the remaining processing steps, which will now be outlined.

In the present method, the high voltage needle array (955) can be charged either positively or negatively. To simplify our explanation, we will assume the high voltage needle array (955) is charged positively. In this situation, the positively charged ions in the corona will be driven by the electric field $E_{drift\ field\ in\ corona}$ toward the conductor grid (905), which is charged by the power supply (911) to a voltage value (denoted generally as Voltage 2) that is lower than that of high voltage needle array 955 (denoted Voltage 1), but still far higher than that of the substrate (i.e., 0 volts before any poling charge arrives). As an example, the typical value of Voltage 2 may be anywhere between 5 kV to 40 kV, whereas that of said high voltage needle array, i.e., Voltage 1, can be between 10 kV and 50 kV, but greater than Voltage 2.

In practice, the conductor grid (905) can be a metal mesh or a screen of conductive material having a plurality of holes, such that charged particles of the corona can pass through relatively easily; other grid materials with similar effects are also permissible. In the terminology of the semiconductor equipment industry, the conductor grid (905), it is like a "shower head" designed to distribute charged particles over the substrate (920) uniformly.

It is to be noted that the property of a polarized ferroelectric polymer thin film material (935) is largely determined by two processing technologies that are incorporated within the overall process, i.e., the coating process technology (e.g., spin-coating, spray coating, PECVD, etc.), and the polarization technology (e.g., corona poling, etc.). In most of the situations, these two process technologies are implemented by different modules/equipment. But ultimately their results may still strongly influence each other. Since an object of the present poling system (900) is to provide a robust design that can polarize ferroelectric polymer thin films under a variety of circumstances, such as different coating technologies, the presently disclosed system incorporates methodologies (e.g., process control using algorithm 800 of FIG. 8) and features (e.g. substrate current sensing device) to meet this objective. Without hesitation, we will assume these methodologies and features as "givens" in the generic design of the presently disclosed corona poling system.

Theoretically, as Eq. (3) reveals, to polarize a ferroelectric thin film in a robust manner, a corona poling system has to provide an in-film electric field, $E_{in\ film}$ in a robust manner, and the value of that $E_{in\ film}$ is a function of the voltage values of two surfaces, the top and bottom surfaces of the ferroelectric polymer thin film (shown in the figure as $V_{top\ surface}$ and $V_{bottom\ surface}$). Thickness of the thin film polymer (i.e., $t_{polymer}$) of course plays another vital role in achieving the final result of poling system/process. According to Eq. (3), there are three parameters that can affect the magnitude of an in film electric field $E_{in\ film}$. The first parameter is the voltage of the top surface of the ferroelectric polymer thin film (935). In the previous sections, we have discussed this issue in detail. The second parameter is the thickness of the ferroelectric polymer thin film ($t_{polymer}$). Note, as Eq. (3) reveals, the thickness of a ferroelectric polymer thin film plays a reciprocal role in determining the magnitude of the in-film electric field, $E_{in\ film}$. For example, in a nominal situation, the thickness of the ferroelectric polymer layer could be only a few μm (microns). If there is any variation of thickness of the ferroelectric polymer layer, it can easily cause a large variation if the in-film electric field (e.g., in a scale of several MV/m). In practice, it is difficult for corona poling process equipment to accurately determine if a ferroelectric polymer thin film at such thickness is extremely flat. Thus, from microscopic point view, it a fair assessment that there may be some intermittent short circuit paths (e.g. pin holes, areas with smaller thickness, defects, etc.) on a ferroelectric polymer thin film in a nominal corona poling process. To accommodate this problem, it is suggested that the voltage value of the bottom surface of a ferroelectric polymer layer be strictly kept at zero volts at all times (see, e.g., the ground connection). If, however, there is any charge reaching the bottom surface (i.e., charges that have travelled across the thickness of said ferroelectric polymer layer due to the above stated intermittent short circuit effects), it is a wise tactic to remove that electric charge by some ESD (electrostatic discharge) or charge dissipation layers (e.g. power/ground plane). The above two methods seem quite straightforward. However, one should be advised that in reality most of the bottom surfaces of the ferroelectric polymer films are attached/sealed to a glass plate. Under this circumstance, it will be very difficult for a process engineer to remove such charge easily. Whenever static charges accumulate at the bottom surface of the ferroelectric thin film, the overall effectiveness of a poling process will be diminished. Hence, to make a corona poling process a robust one, adding some grounding feature on the bottom surface of a ferroelectric polymer thin film would be a wise tactic. The following system/process, therefore, assumes the substrate has a grounding circuitry designed to remove the electric charges from the bottom surface of a ferroelectric polymer thin film during corona poling process.

Note that in certain applications, in addition to the above stated ferroelectric polymer thin film, there may be a device layer (934) deposited on the substrate (930) as well (usually underneath said ferroelectric polymer thin film). Within the device layer (934), there is a plurality of delicate electronic devices (990) such as thin film transistors (TFTs) embedded therein. As a general means of protection, such a device layer (934) has a built-in grounding circuitry (980) and some electro-static discharge protecting features (such as a guard ring or an ESD feature; 970) to prevent its delicate devices from being damaged by the unexpected electro-static discharges. The presently disclosure takes advantage of these features to polarize a ferroelectric polymer thin film in a robust manner.

As has been disclosed in the former section, one of the advantages of the present corona poling system is that it can polarize a ferroelectric polymer thin film by a substantially large in-film electric field in a robust manner. Hence, when a process engineer poles a ferroelectric film, the top and bottom surfaces of a ferroelectric polymer thin film is preferred to be maintained at stable voltage values (i.e., $V_{top\ surface}$, $V_{bottom\ surface}$ in FIG. 9) at all times. Generally, this is not a problem for a dielectric thin film with high breakdown voltage. However, this can be a challenge to a dielectric thin film that undergoes phase transformation process when it is subjected to a high electric field, such as PVDF. As FIG. 9A shows, during the poling process, the current/voltage sensing device (945) serves as an effective means to control/monitor the corona poling process in an in-situ manner. By measuring the delicate variations of said substrate current, i.e. the current/voltage variations caused by the polarization effect of a ferroelectric polymer material, in which Barkhausen noise is abundant, the present system can control the voltage value of the top surface of said ferroelectric polymer material in a robust manner. We now denote the substrate current measured by said sensor (945) as the top surface substrate current ($I_{substrate\ top}$), since it is indeed contributed by the electrical charges from the top surface of said ferroelectric polymer material. In the meantime, the disclosed system provides another means/path to remove the electrical charges from the bottom surface (9100) of said ferroelectric polymer material. As was mentioned in the above, the grounding circuitry (980) embedded in the device layer (934) serves as an ideal means/path to handle this task. We denote the current that flows through this grounding means/path as the second substrate current means/path ($I_{substrate\ bottom}$). As one may envision, the first substrate current means/path ($I_{substrate\ top}$) is preferred to be electrically isolated from that of the second substrate current ($I_{substrate\ bottom}$). Still further, a process engineer can install some EDS (electro-static discharge) features (e.g. guard ring, zener diode, etc.) in the above stated thin structure to maintain said in-film electric field in a safe range. If there is any run away situation (e.g. voltage surge), these features may conduct the extra electrical charges to the ground immediately, the ferroelectric polymer film can stay intact (i.e., no significant variation in in-film electric field). In brief, all the tactics stated in the above have contributions for polarizing a ferroelectric polymer thin film in a robust manner.

In general, the processing ambient used by the presently disclosed corona poling process is the atmosphere. The ideal pressure of said ambient is 1 ATM, or, some pressure values slightly lower than 1 ATM (e.g., a few hundreds Torr). With the above features implemented on system (900), we may now proceed to the remaining corona poling steps.

At the beginning of the process, the power supply (910) provides a voltage at a value denoted as Voltage 1 (typically, from 10 kV to 50 kV) for the high voltage needle array (955). Simultaneously, power supply (911) provides another voltage at a value denoted as Voltage 2 (e.g., from 5 kV to 40 kV, but less than Voltage 1) to the conductor grid (905). The potential difference between Voltage 1 and Voltage 2 establishes an electric field in the corona (9101), which subsequently drives its ions toward the conductor grid (905). Passing through a plurality of holes in the grid, some of the ions will eventually reach the top surface of the ferroelectric polymer thin film substrate (935). As a general method of controlling the in-film electric field ($E_{in\ film}$) in a robust manner, the conductor grid (905) is placed above said ferroelectric polymer material (935) by a distance of only a few mm, so that it can set up a high electric field by induction at the top surface of the ferroelectric polymer material (935). In addition, the corona poling system includes an enclosure ((915), e.g., a bell jar) that can be opened or closed (e.g., raised or lowered) easily. When the corona poling process begins, the enclosure (915) is placed at the "closed" position to isolate the internal poling environment from the external. This is not only a safety measure, but also a proactive means to make sure there is no stray current passing through said enclosure (915) during the process. In essence, there are only two grounding currents, i.e. $I_{substrate\ top}$ and $I_{substrate\ bottom}$, that have to do with the in-film electric field in the ferroelectric polymer thin film. According to the design of the presently disclosed system, any stray current in the corona can affect the delicate readings on the above two kinds of substrate current. If that occurs, the poling condition of a ferroelectric polymer thin film (935) can be drastically changed. Thus, enclosure (935) is a component needed for the presently disclosed corona poling system in that it helps the corona poling system to polarize a ferroelectric polymer thin film (935) in a robust manner.

That shape of the high voltage needle arrays (955) also has to do with creating the robust design of the presently disclosed corona poling system. Note that the high voltage needle array (955) includes a plurality of sharp metal pins (955*a*), (955*b*), . . . and (955*i*). These sharp pins have a sharply tapered tip, in whose vicinity the electric field is extremely strong due to their curvature. When the high voltage (Voltage 1) is applied to the needle array (955), and when the pressure of the processing ambient inside said enclosure (915) falls within a range suitable for exciting a corona (e.g., between 300 and 800 Torr), a strong ionization effect occurs on the ambient gas molecules. The high voltage needle array (955) may be replaced by a plurality of parallel thin metal wires. In this case, the curvature of thin wires also forms a strong electrical field, and the curved contour of the wires also makes the ionization process of the ambient easier. In short, the system can adjust the shape of the tip of the high voltage electrode (955) as well as its contour to make a corona poling process more reliable (e.g. insure that a streamer or arcing effect is less likely to happen).

Figure 9B:
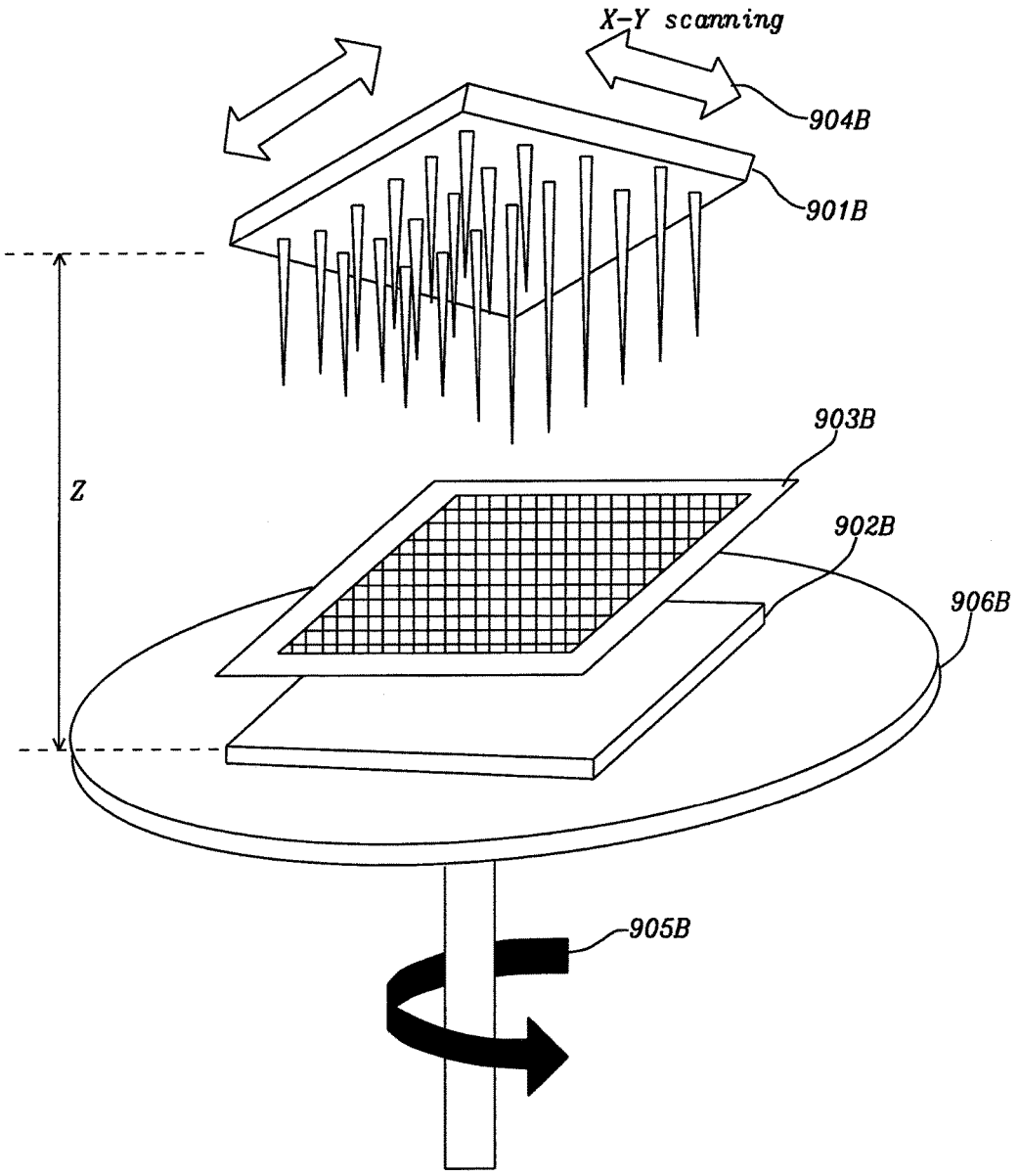
FIG. 9B schematically depicts a generic system platform that, by causing a relative intermediate displacement between the high voltage needle array and the substrate, or between the grid and the substrate, achieves a uniformity of the poling effect on the ferroelectric film.

When the area of the substrate is relatively large (e.g., 1 $m^2$), the conductor grid (905) plays the vital role of maintaining a good uniformity of a poled ferroelectric polymer thin film. This has to do with the in-film electrical field established in the film. According to fundamental physics, an in-film electric field that is in the vertical axis (i.e. the Z axis of FIG. 7) is most effective for polarizing a ferroelectric polymer. Thus, a robust corona processing tool should require that the poling current has no components in lateral directions (e.g., X axis direction in FIG. 9A). The diameters of the holes of the conductor grid, and the distance between the conductor grid and the substrate can be adjusted to maximize the current in the proper direction. FIG. 9B shows a method for achieving extraordinary poling uniformity (e.g. to a microscopic scale of micrometers or sub-micrometers). As FIG. 9B shows schematically, a relative movement (904B) is made between the high voltage source (901B) and the substrate (902B). In this situation, as the arrows in the figure show, such relative movement may include X-Y scanning of the source assembly (904B), rotation of the substrate (905B), Z-direction adjustment of the distance between the source assembly and the substrate, or any combination of these movements.

Figure 10:
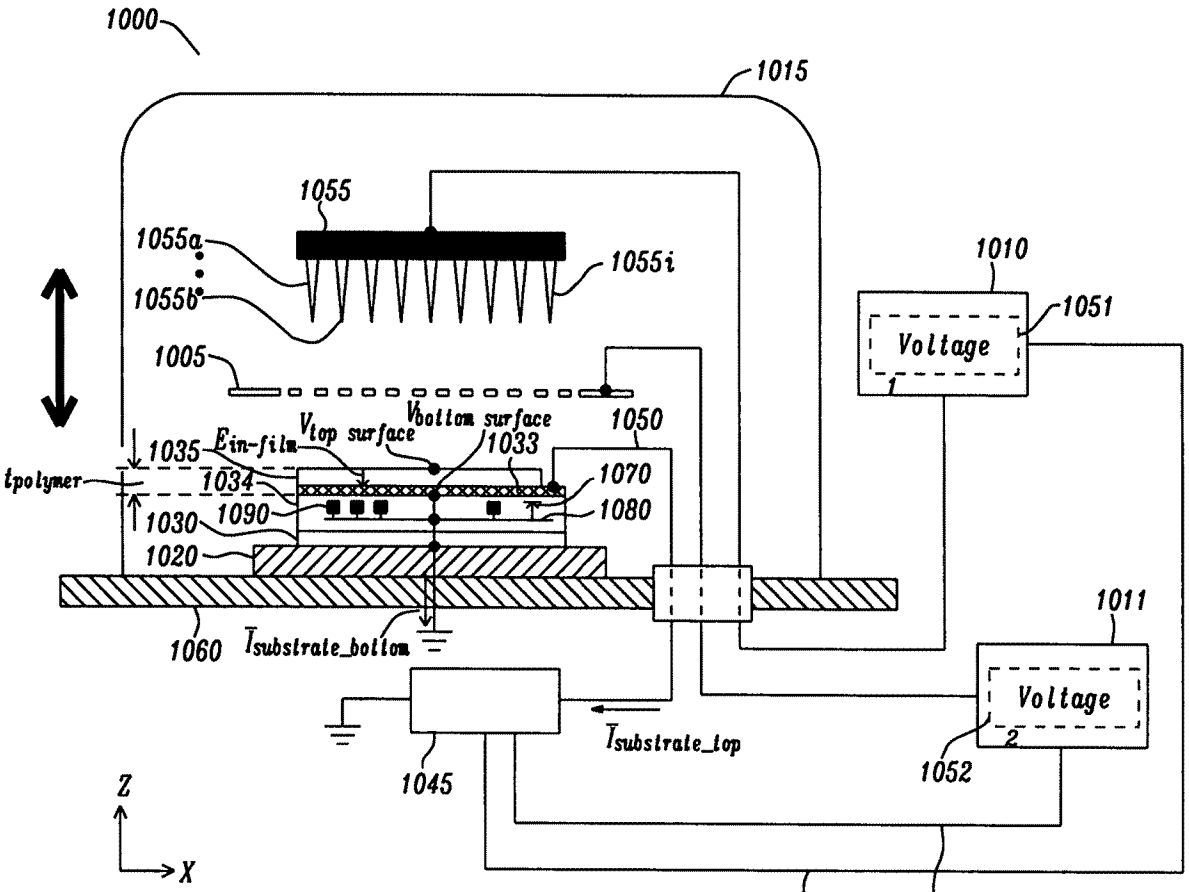
FIG. 10 schematically illustrates a variation of FIG. 9A showing an alternative method of bleeding off extra charge to ground.
Figure 11:
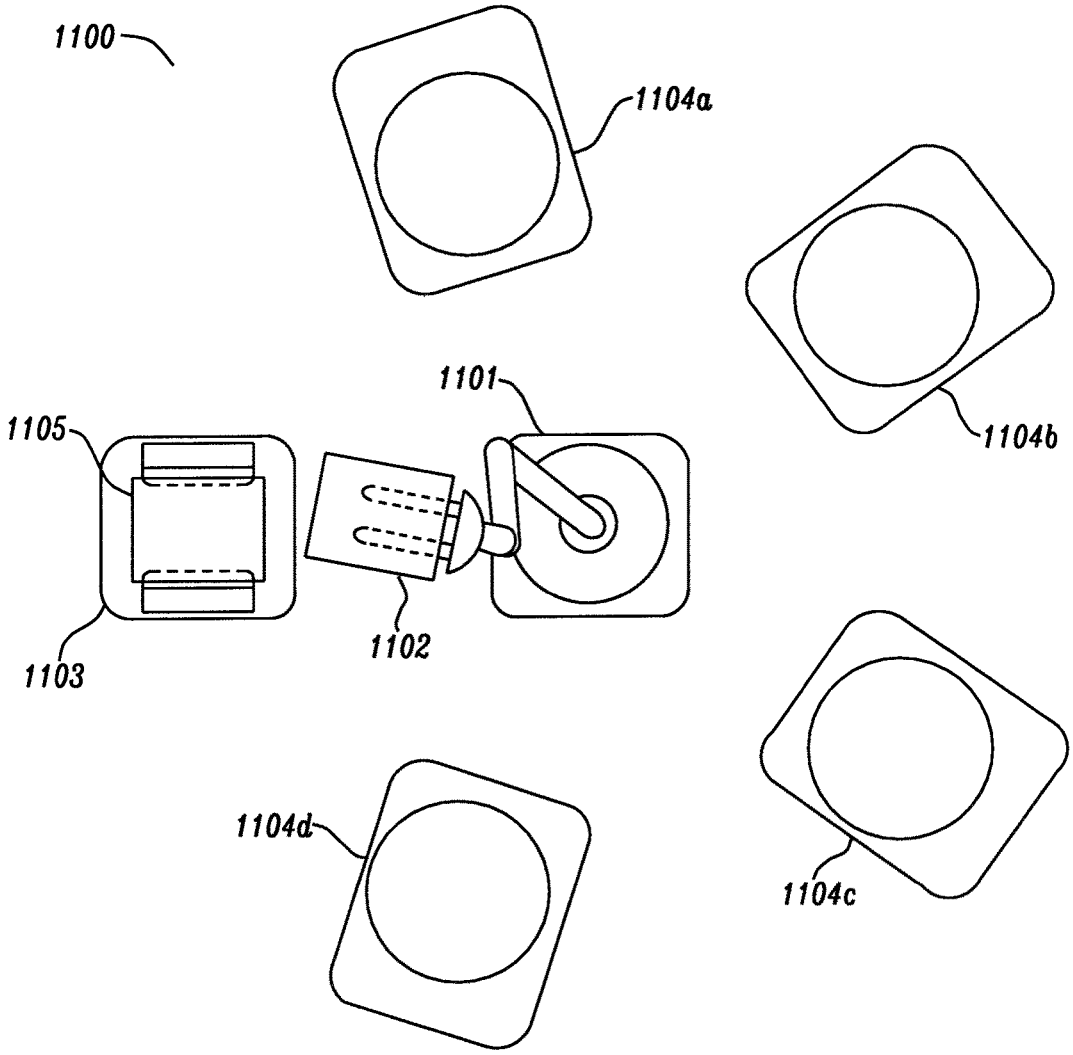
FIG. 11 schematically depicts the cluster system of Embodiment 1.

FIG. 10 schematically depicts another system architecture that resembles that of FIG. 9A quite closely. In fact, the major difference between FIGS. 10 and 9A is in the current meter (e.g., 945 vs 1045) used to measure the substrate current and its mode of contact to the thin film. As FIG. 10 shows, a testing probe (1050) is touching a conductive layer (1033 e.g. an ITO or ZnO, metal layer of nm thickness). The conductive layer (1033) is inserted between the ferroelectric thin film layer (1035) and the delicate electronic layer (1034). It is very important to note that the conductive layer (1033) is linked to a grounding circuitry 1080 via an ESD (electrostatic discharge) feature (1070). Thus, during the corona poling process, the entire bottom surface of the ferroelectric polymer thin film will be maintained at a voltage near to zero (the ground) at all times. If there is any substantial amount of charges remaining on the bottom surface of the ferroelectric polymer thin film (935), they will be conducted to the ground via the ESD feature (1070). In nominal situation, the substrate current ($I_{substrate\ top}$) will go along path (1050) since the ESD is at open status. In an abnormal situation, the surging voltage of the conductive layer (1033) will cause the ESD feature to close, substrate current thus takes a secondary route (i.e. $I_{substrate\ bottom}$) to the ground. Under this circumstance, the current measured by the current meter (1045) will be nearly zero (information lost). Thus, one comes to the realization that there is a price to pay for when a corona poling test adds an ESD feature to the contact point of substrate current, a lost signal whenever said ESD is closed (conducting). In many situations, these extra charges provide a rich amount of information for a process engineer to identify certain phenomena occurring in a ferroelectric polymer thin film (1035). However, that does not necessarily mean FIG. 10 is a bad design. For example, once a comprehensive process of corona poling is identified, a process engineer can deliberately add an ESD feature to a film structure as FIG. 10 depicted, in this design said ESD feature will knowingly not enter the closed stage during the corona poling process. In that case, the design of FIG. 10 is a friendly one to mass-production process (i.e., no loss to unexpected ground bounce). In Essence, device protection can be a critical matter for a corona poling process. There are quite a few contingent ways to tackle the associated ESD problems; what FIG. 10 teaches is a compromised method that measures the substrate current while occasionally losing some charges to a secondary grounding path (i.e. whenever there are extra charges on the bottom surface of the ferroelectric polymer thin film (1035)).

Additional Embodiments

In the following section describing additional embodiments, we disclose two types of processing equipment that can implement the presently disclosed intelligent corona poling process: a cluster type system, and an in-line type system. A cluster system has the capability to produce products at a reasonably large volume while accommodating large variations among its different chambers/modules. The productivity of in-line type equipment can be even larger, but modification of its respective chambers or processes is limited. In the present disclosure, the preferred embodiment is a cluster type system, whose typical architecture is disclosed in embodiment 1. Embodiment 2 discloses an in-line type corona poling system.

Despite the fact that both types of systems can utilize the same presently disclosed corona poling process, one has to keep in mind that the fundamental performance of the two types of equipment varies significantly; and this difference is especially evident when one examines the microstructures of ferroelectric polymer thin films polarized by these two systems. Hence, despite the fact that both sets of equipment may use the same poling electrode or conductor grid, the poling currents and voltages actually deposited on the same substrate may still be different. Thus, the fundamental differences between these two systems has to be gathered from microstructural perspectives. As has been explained in the previous paragraphs, the directionality of the in-film electric field (i.e. $E_{in\ film}$) in a ferroelectric thin film will affect the result of a corona poling process, in that movement of domain walls changes in accordance with different electric field in the ferroelectric polymer thin film. Because the magnitude and/or directionality of the in-film electric field can be different in the above two types of equipment, the associated processes must be adjusted by considering their fundamental design differences. Specifically, in the cluster case the substrate is in static mode, while in the in-line case it is in a motion mode. Fortunately, we have developed solutions for this issue. When a process engineer conducts a corona poling process based on the present disclosure, there should be no difficulty in reaching a satisfactory result using either type of equipment.

Embodiment 1: Cluster Architecture

FIG. 10 schematically depicts the architecture of a cluster type processing system. As FIG. 10 shows, there is a plurality of separate process chambers/modules (1104*a*-1104*d*) mounted (here, in a substantially circular arrangement) on a cluster system platform (1100). A holding cassette (1103) contains a plurality of separate substrates (e.g., 1105 being shown) that are awaiting application of a poling process. A substrate handling robot (1101) is shown in the process of transferring a substrate (1102) from the cassette (1103) to one of the empty process chambers/modules, e.g., (1104*a*). Upon transferring substrate (1102), the robot (1101) may return its attention to the cassette (1103), pick up another substrate (e.g., 1105) and repeat the transfer process to another waiting process chamber (e.g., 1104*b*, 1104*c*,

1104*d*). In a similar fashion, the robot may remove a substrate from its process chamber at the completion of a process (not shown).

In the former section (i.e. section 5), we have provided the general rules of designing a robust corona poling chamber/system. In this embodiment, without repeating the previous process steps, we apply all the teachings in section 5 to the individual process chambers. In accord with the properties of cluster type equipment, each of the process chambers/modules handles one substrate at one time. During the poling operation, each process chamber/module (e.g., 1104*a*, 1104*b*, 1104*c*, 1104*d*) is capable of providing the same or a different process than that being applied in the other chamber/modules (e.g., corona poling, PECVD, PVD, etc.).

Returning to FIG. 9A, we may also learn from the rules we have applied to designing a robust corona poling chamber/system (i.e. section 5), that in order to pole a ferroelectric polymer thin film (935) having delicate devices (934) embedded therein, a "pervasive coverage", i.e., a deposition of the ions that is uniform across the surface of the substrate, and causes a corresponding uniformity of the poling current through the substrate (930) is preferred. In a corona poling process that has such a desired pervasive coverage poling current, the system/process can not only control the final properties of a ferroelectric polymer thin film in a robust manner, but can also prevent the delicate electronic devices that may be embedded in the substrate (e.g., 990) from being damaged by stray current or uneven electric fields in lateral direction (e.g. X-Y axes). In practice, the corona poling system of FIG. 9A achieves the above goals by use of a large area conducting grid (905) and a substrate holder that passes almost all electrical charges to the ground only via the substrate current path(s) designated by the presently disclosed system.

As FIG. 9A also shows, when the area of the conducting grid (905) is about the same as that of substrate (920), the entire ferroelectric polymer thin film material (935) is subjected to a unified in-film electric field i.e. $E_Z$; this leads to a situation that an in-film electric field having a unified magnitude and direction (i.e. Z axis) may polarize the whole the substrate.

Microscopically, the uniform in-film electric field has a favorable influence on phase transformation processes along a principal axis (i.e. Z axis), and this influence on phase transformations by a uniform in-film electric field can also be expressed by the zero magnitude of $E_x$ in X axis direction. Whenever there is only one component of $E_z$ field (i.e. $E_z$), and there is no $E_x$ field on the entire substrate, the microstructure of the ferroelectric polymer thin film will be transformed by a poling condition that is consistent everywhere in the film. In this case, the associated phase transformation process can be controlled more easily, and its Barkhausen noise spectrum is more discernable, so that a particular signal profile may be picked out from the spectrum more easily. Taking advantage of this fundamental advantage, the system disclosed in embodiment 1 can diagnose the Barkhausen noise more accurately (as compared to the counterpart in FIG. 9A), and thereby the processing end point can also be determined more accurately.

Embodiment 2

Figure 12:
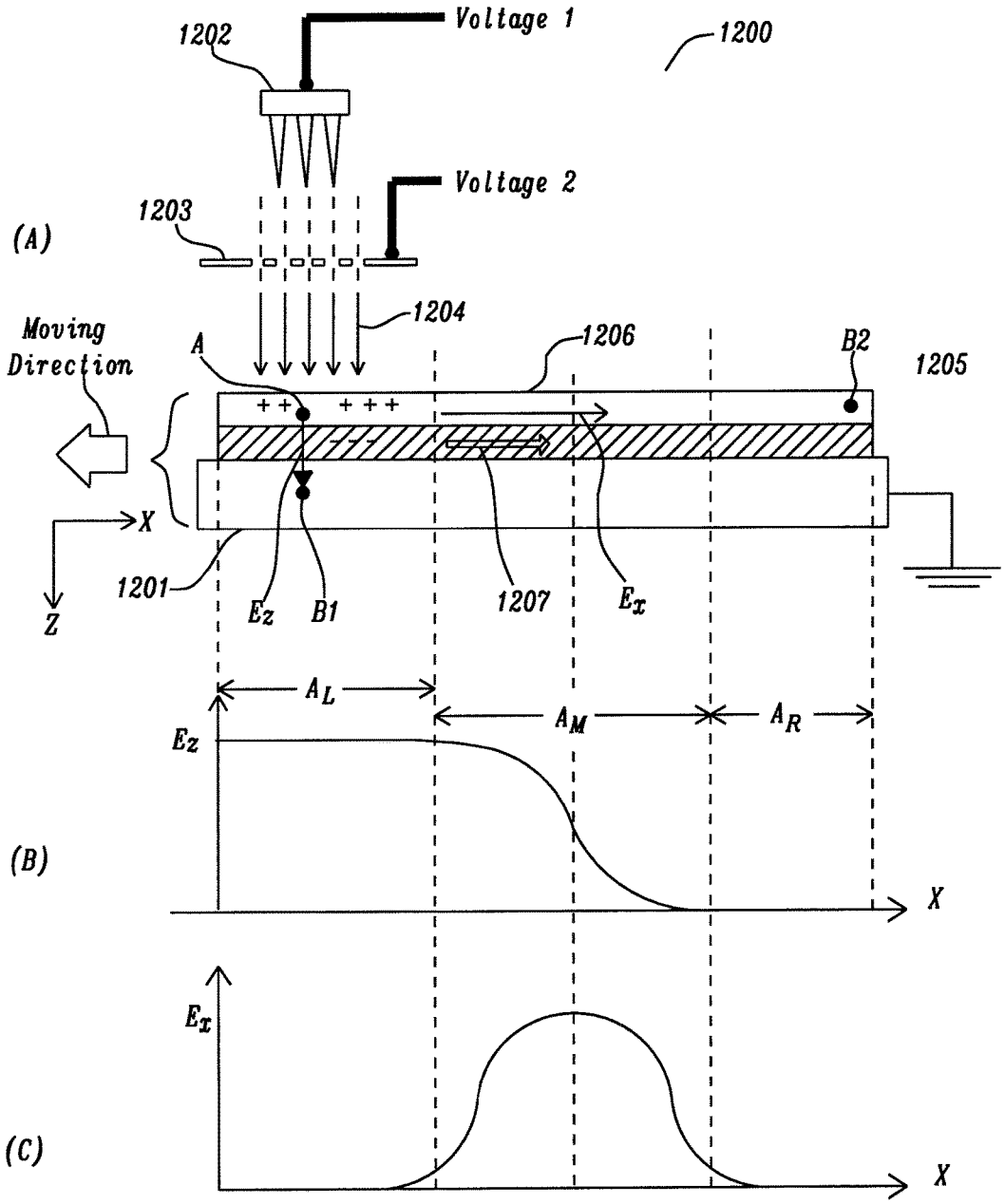
FIG. 12 schematically depicts the in-line system of Embodiment 2.

FIG. 12 discloses a process chamber/module of an in-line type corona poling system. An in-line system can be further categorized as a static version of a continuous type of process. In a continuous type in-line corona poling system, the substrate (1201) is in motion (to the left) when it is passing beneath a conductor grid (1203), which is substantially narrower than the substrate itself. In the static version (as in FIG. 9), the substrate (1201) is held immobilized when the corona poling process is carried out. Both types of in-line system, static and moving, can polarize a ferroelectric polymer thin film. The advantages of one type over the other of the two in-line systems varies, in that the crystalline structure, trapped charges, etc., of the ferroelectric films poled by two types of in-line poling systems are different. During processing, the fundamental reason for their differences can be verified by their Barkhausen noise/substrate current. We will elaborate the respective sources of Barkhausen noise in the following.

Referring to FIG. 12, we note again that the substrate is much wider than the grid (1203) and is moving relative to the grid. To simplify our discussion, we return to FIG. 12 and note that we may divide the entire area of the substrate (1201) into three segments, $A_L$, $A_M$, and $A_R$, which denote the left, middle, and right regions of the substrate (1201). Now we will examine the direction of the in-film electric field in the three regions. First we look into the left region (denoted by $A_L$) of the substrate (1201), it is this region that receives the poling current (1204; we assume the poling charge are positive). In this region $A_L$, there is a strong in-film electric field along the Z axis of the ferroelectric polymer thin film (1206). As FIG. 12(B), the graph of $E_Z$ vs. position along the substrate, shows, the charges have established a plateau in the electric field magnitude $E_Z$ along the direction of the Z axis in the entire region of $A_L$. As FIG. 12(A) shows, the size (width) of the conductor grid (1203) is smaller than that of the substrate (1201). This size difference causes a unique situation: while substrate (1201) is moving from right to left, only a portion of the entire substrate (1201) area is receiving the electrical charges provided by the poling current (1204). Thus, while region $A_L$ is being poled by said strong in-film electric field, region $A_R$ remains unchanged, i.e. there is no poling effect due to a nearly zero in-film electrical field. On the other hand, as FIG. 12(B) shows, in the middle region denoted as $A_M$, there still is a "transient" in-film electric field. The magnitude of this "transient" in-film electric field is lower than that in $A_L$, and it is decreasing towards the right direction (positive X axis). What one may notice, as FIG. 12(C) shows, there is another in-film electric field in the X axis within the $A_M$ region. This field in the middle region is largely caused by the voltage difference between region $A_L$ (about the value of Voltage 2) and $A_R$ (literally zero volts, since there is no electrical charge in the right-most region). Thus, the combined electric field in region $A_M$ is no longer strictly along said Z axis. As a result of the combined in-film electric field, a stray current (1207) is meandering along the top surface of said substrate (1201). Accordingly, due to proximity induction effect, there may be some induced meandering currents in the power line, ground line, or interconnection schemes of the electronic device layer (1205). Under such a circumstance, the process engineer has to verify if the delicate devices embedded in a stack of films incorporating a device layer can withstand such a lateral electric field. For example, a process engineer has to verify if the electrostatic discharge (ESD) features on the power and ground lines are robust enough to withstand the induced meandering current. If there is any electronically active device (e.g., TFTs, etc.) embedded in substrate (1201) that is vulnerable to said meandering current problem, a naive design as FIG. 12(A) shows may inadvertently damage said active devices. On the other hand, if said active device (e.g., TFTs, lying in layer (1205)) is strong enough to withstand said meandering current, then embodiment 2 can be a viable technological solution for high volume production process (the production throughput of an in-line system still can be adjusted by adding/removing process modules).

Revisions and modifications may be made to methods, materials, structures and dimensions employed in forming and providing a system and method for polarizing thin film ferroelectric materials, while still forming and providing such a system and method in accord with the spirit and scope of the present disclosure as defined by the appended claims.

We claim:

1. An apparatus for polarizing ferroelectric thin-film polymer materials, comprising:

a system platform including a substrate holder configured to accept a substrate comprising a polarizable thin-film material;

a high voltage discharge electrode formed above said substrate holder and fixed in position relative thereto;

a grid electrode formed between said discharge electrode and said substrate holder and fixed in position relative thereto;

an air-tight, removable enclosure formed over said system platform, thereby enclosing said substrate holder, said discharge electrode, said grid electrode and configured to maintain an ionizable ambient gas at a determined pressure, wherein said air-tight enclosure removably contacts said system platform to form a seal thereat that can be broken to allow said enclosure to be lifted from said system platform to expose said substrate holder, said discharge electrode and said grid electrode;

a controllable power supply configured to place said discharge electrode at a discharge electrode potential, Voltage 1, and said grid electrode at a grid electrode potential, Voltage 2, both potentials being relative to said substrate holder; wherein when said discharge electrode is placed at a suitably higher potential than said grid potential and when both said potentials are suitably higher than that of said substrate holder, then a flux of charged particles produced by ionization of said ambient gas by said discharge electrode and regulated and dispersed by said grid electrode will impinge on a polarizable thin-film affixed to said substrate stage and thereby create a polarizing current flowing between said grid electrode, through said thin-film substrate and thence to ground;

a first system to monitor said polarizing current as a function of time;

a second system to analyze said monitored polarizing current and evaluate a process status as a result of certain features of said polarizing current;

wherein said first and said second systems are configured to use said evaluation of said polarizing current to determine an end-point of the process and of terminating said process when said end-point is reached.

2. The apparatus of claim 1 wherein a device layer is interposed between said substrate holder and said ferroelectric thin-film material.

3. The apparatus of claim 2 wherein said polarizable thin-film material is a thin film that is spun onto said device layer.

4. The apparatus of claim 1 wherein said discharge electrode potential is between approximately 10 kV and 50 kV and said grid electrode potential is between approximately 5 kV and 40 kV and said discharge electrode potential is maintained higher than said grid electrode potential.

5. The apparatus of claim 1 wherein a substrate heater is formed between said substrate holder and said system platform.

6. The apparatus of claim 1 wherein said power supply is positioned externally to said enclosure and is connected to said discharge electrode and said grid electrode by an interconnection passing through said system platform.

7. The apparatus of claim 1 wherein said discharge electrode is formed as a planar conducting surface of approximately the same area as said substrate holder and from which project a multiplicity of conducting pointed metal pins.

8. The apparatus of claim 1 wherein said discharge electrode is formed as a planar rectangular frame of substantially the same area as said substrate stage and that supports a multiplicity of parallel conducting wires.

9. The apparatus of claim 1 wherein said grid electrode is formed as a planar metal mesh or screen that is parallel to said discharge electrode and of approximately the same area.

10. The apparatus of claim 1 wherein the gas pressure within the enclosure is in the range of between approximately 400 Torr and 800 Torr.

11. The apparatus of claim 1 wherein said first system includes monitoring circuitry communicating with said substrate holder and, thereby, with said polarizable thin-film layer and optional device layer on said substrate holder, wherein said circuitry is configured to monitor a polarizing current or voltage being applied to said thin-film layer and said optional device layer to determine a condition of polarization of said layers and a status of polarization processing being applied to said layers.

12. The apparatus of claim 11 wherein said circuitry is configured for end-point determination of said polarization process through monitoring of a substrate current of said polarization process and wherein said circuitry thereby controls said polarizing current in-situ through said second system that monitors features of said polarizing current, including average time rate of change and oscillation profile, to determine a point in time at which the rate of substrate current change reaches a pre-determined value.

13. The apparatus of claim 1 further including an ESD (electrostatic discharge) device for eliminating excess buildup of charges on said substrate surfaces.

14. The apparatus of claim 13 further including additional monitoring circuitry to prevent loss of information if said ESD device channels said excess charges to ground.

15. The apparatus of claim 1 wherein said ferroelectric polymer is poly-vinylidene difluoride, (PVDF), PVDF-TrFE, PMMA, or TEFLON.

16. An apparatus for in-line corona polarizing of ferroelectric thin-film polymer materials, comprising:

a linearly moving system platform configured to accept a substrate including a ferroelectric polymer thin-film material;

a fixed discharge electrode formed above a portion of said substrate relative to which said system platform moves;

a grid electrode formed beneath said discharge electrode and fixed in position relative thereto;

a power supply configured to place said discharge electrode at a discharge electrode potential, Voltage 1, and said grid electrode at a lower grid electrode potential, Voltage 2, both potentials being relative to a zero potential of said moving system platform; wherein when said discharge electrode is placed at a suitably higher potential than said grid potential and when both said potentials are suitably higher than that of said substrate, then a flux of charged particles produced by said discharge electrode and regulated by said grid electrode will impinge on said ferroelectric polymer thin-film material affixed to said system platform and thereby polarize said ferroelectric polymer thin-film material; and wherein said discharge electrode and said grid electrode are of approximately equal lengths and wherein said lengths are substantially comparable to a portion of a length of said substrate, whereby, as said substrate moves past said discharge and grid electrodes said flux of charged particles impinges on a sufficient length of said substrate stage so that said layer of ferroelectric polymer thin-film material and an optional device layer in contact with said electret-forming material, both affixed to said system platform are not subjected to imbalanced charge distributions and excessive currents.

17. An apparatus having a cluster architecture and configured to polarize ferroelectric polymer thin-film material, comprising:

a holding cassette holding a multiplicity of separate substrates;

a substrate-handling robot configured to extract one of said multiplicity of separate substrates from said holding cassette and of placing said substrate into a processing chamber;

a cluster of processing chambers arrayed about said substrate-handling robot wherein each processing chamber in said cluster is configured to receive a substrate from said robot; wherein each of said cluster of processing chambers is equipped with a system configured to perform a corona polarizing process on a thin-film ferroelectric polymer and of polarizing said thin-film ferroelectric polymer and wherein;

each of said separate substrates includes a layer of thin-film ferroelectric polymer material.

18. A method of polarizing a thin-film ferroelectric polymer comprising:

providing a substrate including a thin-film ferroelectric polymer and, optionally, a device layer formed contacting said thin-film ferroelectric polymer;

placing said substrate within a processing chamber configured to perform a corona polarizing process;

establishing, between a high voltage discharge electrode and a lower voltage control grid a controlled corona discharge within said processing chamber, wherein said controlled corona discharge produces a distribution of ionized particles impinging on said substrate to create a substrate current;

monitoring said substrate current using a first system of sensors wherein output of said sensors provide feedback to a second system configured to control said substrate current;

determining, from analysis of a substrate current profile produced by said output of said sensors, an end-time at which an optimal amount of β phase of said substrate has been created, at which end-time further polarization would be disadvantageous for the longevity of said polarized ferroelectric polymer thin-film; then terminating said polarizing process at said end-time.

19. The method of claim 18 wherein said profile of said substrate current corresponding to said end-time has already exhibited an oscillatory behavior characteristic of Barkhausen noise.

20. The method of claim 19 wherein said Barkhausen noise is determinative of the creation of a β crystalline phase of said ferroelectric polymer thin film, wherein said β phase corresponds to a desired polarization phase.

21. The method of claim 18 wherein continual in-situ analysis of said substrate current profile is implemented by a continual evaluation of said profile to determine the occurrence of said Barkhausen noise and the general slope of said profile prior to and subsequent to said Barkhausen noise.

22. The method of claim 18 wherein said substrate is heated to a temperature determined to optimize the creation of said β phase.

23. The method of claim 21 wherein said optimal processing time occurs when further positive effect of an in-film electric field that produces said polarization is reduced as a result of charge recombination on the surface of said ferroelectric polymer thin-film, as verified by the structure of a hysteresis curve that plots the polarization against the in-film electric field.

24. The method of claim 21 wherein said continual evaluation controls a monitoring process of said substrate current and confirms the optimum end-time of said polarization process by a confirmation of multiple declining points in said substrate current profile followed by formation of a plateau in the substrate current slope.

25. The method of claim 18 wherein said processing chamber is disposed within a cluster architecture and wherein said substrate is chosen from a modular assembly configured to hold a multiplicity of substrates and to place them individually within said processing chamber.

26. The method of claim 18 wherein said processing chamber is configured to process a substrate in linear motion and wherein a distribution of ionized particles formed in a corona discharge within said processing chamber impinges on said substrate and polarizes said substrate.

27. The method of claim 18 wherein uniform polarization is enhanced by causing an in-film electric field to be perpendicular to the plane of the film, which, in turn, is facilitated by creating relative lateral motion of the film plane with respect to the high voltage discharge electrode.

* * * * *